US005953554A

United States Patent [19]

Ohnishi et al.

[11] Patent Number: 5,953,554

[45] Date of Patent: Sep. 14, 1999

[54] IMAGE FORMING APPARATUS WITH A TONER DENSITY MEASURING FUNCTION

[75] Inventors: Kazuyuki Ohnishi, Yamatokoriyama; Katsuhiro Nagayama, Yamabe-gun, both of Japan

[73] Assignee: Sharp Kabushiki Kaisha, Osaka, Japan

[21] Appl. No.: 08/953,395

[22] Filed: Oct. 17, 1997

[30] Foreign Application Priority Data

Nov. 28, 1996 [JP] Japan ..... 8-317960

[51] Int. Cl.[6] ..... G03G 15/00

[52] U.S. Cl. ..... 399/49; 399/74

[58] Field of Search ..... 399/49, 72, 74

[56] References Cited

U.S. PATENT DOCUMENTS

| | | | |
|---|---|---|---|
| 4,801,980 | 1/1989 | Arai et al. | 399/29 |
| 5,097,293 | 3/1992 | Seto et al. | 399/11 |
| 5,245,390 | 9/1993 | Ishigaki et al. | 399/74 |
| 5,325,153 | 6/1994 | Mitsuse et al. | 399/74 |
| 5,477,312 | 12/1995 | Hori | 399/74 |
| 5,497,221 | 3/1996 | Takemoto | 399/74 |
| 5,543,895 | 8/1996 | Katsuhara | 399/59 |
| 5,652,952 | 7/1997 | Katsuhara | 399/72 |

FOREIGN PATENT DOCUMENTS

| | | |
|---|---|---|
| 60-260066 | 12/1985 | Japan . |
| 4-284466 | 10/1992 | Japan . |

*Primary Examiner*—Robert Beatty
*Attorney, Agent, or Firm*—David G. Conlin; William J. Daley, Jr.

[57] ABSTRACT

The static latent image formed on the photoreceptor which has been charged, by exposing it to light, is developed through four colors of developing units, i.e., yellow, magenta, cyan and black, forming toner images on the photoreceptor. These toner images are transferred to the transfer drum. Before forming the toner images, a device is provided to correct the measurement value of toner density obtained using the light emitter and photosensor into an exact value. Based on the reflected light from a white-coated area formed on the transfer drum, two levels of the intensities of emitted light are determined. The intensity of received light is compared to the standard value so that the output value from the photosensor corresponding to the toner density is made to approximate the standard value.

24 Claims, 18 Drawing Sheets

FIG. 14

| D | TABLE |
|---|---|
| 6 | 70 |
| 5 | 68 |
| 4 | 67 |
| 3 | 65 |
| 2 | 63 |
| 1 | 62 |
| 0 | 60 |
| −1 | 57 |
| −2 | 56 |
| −3 | 55 |
| −4 | 55 |
| −5 | 54 |
| −6 | 54 |

IMAGE FORMING APPARATUS WITH A TONER DENSITY MEASURING FUNCTION

BACKGROUND OF THE INVENTION (1) Field of the Invention

The present invention relates to an image forming apparatus which has a means of measuring the toner density and correcting its measurement to a correct value and can be applied to electrophotographic copiers, laser beam printers, etc.

(2) Description of the Prior Art

In image forming apparatuses using an electrophotographic process such as copiers, laser beam printers, etc., the photoreceptor which has been charged is exposed to light to create a static latent image, and the latent image is developed into a toner image whilst a developing bias voltage is being applied. The image forming apparatus of this kind has suffered from an image degradation problem in that the density of the toner image fluctuates due to change in surrounding conditions such as temperature, humidity etc., or due to change with the passage of time, i.e., aging, so that medium-gradation image density is not reproduced uniformly. In order to avoid image degradation, various methods have been proposed. One of these methods comprises the steps of forming a toner image under prescribed conditions on the photoreceptor or a transfer member which is arranged in contact with the photoreceptor; reading the intensity of reflected light using a reflection type optical sensor; and controlling the control parameters for image forming based on its difference from a reference value. For example, Japanese Patent Application Laid-Open Sho 60-260066 discloses a configuration in which two toner images having different densities, i.e., dark and light are formed on the photoreceptor so that the densities are read by two reflection type sensors.

In Japanese Patent Application Laid-Open Sho 60-260066, it is specified that the two sensors preferably have equivalent characteristics. In practice, however, the characteristics of the light emitter and photosensor of such a sensor differs from one to another due to their individuality and varies due to temperature, degradation from a prolonged period of its usage and its geometry, i.e., the angle, distance etc. between the sensor and the target, producing the problem of degraded accuracy of measurement.

It is possible to achieve a relatively exact measurement of two levels of density if the operational points of the sensors for the two levels of density are corrected. However, when three or more colors of toner are used or the sensor has non-linear characteristics, it is not always possible to make exact correction for all the colors of toner.

In the case where toner images for the measurement of density are formed under the specified conditions and based on the result of the measurement of density the image forming conditions for the image forming system will be corrected in order to stabilize the operation of forming toner images, the light intensity for measurement is set up in conformity with the density of the toner image in the initial stage. Even in such a configuration, however, the toner image for the measurement of density will vary due to change in surrounding conditions or due to the passage of time, and therefore problems often occur that the toner density does not go with the light intensity for measurement.

SUMMARY OF THE INVENTION

It is therefore an object of the present invention to provide an image forming apparatus with a toner density measuring function, which can correct its measurement to a correct value even when the sensor characteristics of measuring the density of toner vary or even when the density of the toner image varies.

The present invention has been devised in order to achieve the above object and is configurated as follows:

In accordance with the first aspect of the invention, an image forming apparatus with a toner density measuring function, for forming a toner image by exposing a charged photoreceptor to light so as to form a static latent image thereon and developing the latent image with toner, comprises:

- a light emitting portion of which the intensity of light can be adjusted;
- a toner image forming portion for forming a toner image for the measurement of toner density;
- a reflective element having a constant reflectance for reflecting the light emitted from the light emitting portion;
- a photo sensing portion for receiving the reflected light from the reflective element or the toner image;
- a first light intensity determining means for determining the first intensity of light to be emitted from the light emitting portion in a way that causes the photo sensing portion to produce a predetermined output value when receiving the reflected light from the reflective element;
- a second light intensity determining means for setting the second intensity of light emitted from the light emitting portion, at a level different from that of the first intensity of emitted light; and
- a means of correcting density measurements which compares to a standard value the outputs from the photo sensing portion when receiving the reflected light from the reflective element in the cases where the first and second intensities of emitted light are used and causes the output from the photo sensing portion for the toner density measured when the first intensity of emitted light is radiated to approach the standard value.

In accordance with the second aspect of the invention, the image forming apparatus with a toner density measuring function having the first feature of the invention, is further characterized in that the second light intensity determining means determines the intensity of emitted light for each of plural colors of toner, and the means of correcting density measurements corrects the measurement value for each of the plural colors of toner.

In accordance with the third and fourth aspects of the invention, the image forming apparatus with a toner density measuring function having the above first or second feature is characterized in that the first light intensity determining means sets the first intensity of emitted light at a level which falls within the sensitive range of the photo sensing portion and is higher than the second intensity of emitted light.

In accordance with the fifth and sixth aspects of the invention, the image forming apparatus with a toner density measuring function having the above first or second feature is characterized in that the reflective element is used as the background for the measurement of the density of the black toner and has a higher reflectance than that of any other toner image.

In accordance with the seventh and eighth aspects of the invention, the image forming apparatus with a toner density measuring function having the above first or second feature is characterized in that the second light intensity determining means sets the second intensity of emitted light at such a level that the output value from the photo sensing portion when the toner image is measured with the first intensity of emitted light becomes approximately equal to the output value from the photo sensing portion when the reflective element is measured with the second intensity of emitted light.

In accordance with the ninth and tenth aspects of the invention, the image forming apparatus with a toner density measuring function having the above first or second feature is characterized in that, based on the intensity of received light as of the toner image obtained when the density of the toner image formed on the toner image forming portion was measured, at least one of the image forming conditions is controlled so that the density of the toner image is adjusted so as to provide an intensity of received light from the toner image, which is close to the intensity of received light from the reflective element when the reflective element is illuminated with the second intensity of emitted light.

In accordance with the eleventh and twelfth aspects of the invention, the image forming apparatus with a toner density measuring function having the above first or second feature is characterized in that the reflective element is provided so as to move relative to the light emitting portion and the photo sensing portion, and the operations of the first and second light intensity determining means are executed at the same position in the reflective element.

In accordance with the thirteenth and fourteenth aspects of the invention, the image forming apparatus with a toner density measuring function having the above first or second feature is characterized in that the reflective element is moved relative to the light emitting portion and the photo sensing portion so as to effect measurement at plural sites and the measurements are averaged to be used for correction.

In the above first configuration of the invention, on the occasion of correcting the characteristics of the sensor for measuring the toner density, it is possible to correct the sensor characteristics at two operational points of the sensor by irradiating the reflective element having a specified reflectance as a reference with two levels of intensities of emitted light. Generally, when the light intensity from the light emitting portion has been adjusted based merely on the detected intensity of reflected light from the reflective element, the ratio of variations in the output from the photosensor with respect to the density of a toner image to be measured is not necessarily constant. As a result, from the output from the photosensor the toner density of a toner image as dense as that of the reflective element can be measured exactly, but the output from the photosensor when a toner image with a density which is deviated from that of the reflective element is measured does not always represent the correct toner density. This situation can be bettered by the correcting method of the invention. Accordingly, on the occasion of correcting the operational conditions of the image forming system, it is possible to calculate correction values more exactly.

On the other hand, it may be considered that the sensor reading of measurements can be well corrected by providing a second reflective element which has a different reflectance from that of the first reflective element and measuring the light intensities from the two reflective elements. In this case, however, it is necessary to provide two reflective elements of which the levels of density are strictly controlled within definite ranges, producing problems of the cost and arrangement. In this invention, the correction needs only one reflective element having a single level of reflectance, the cost required for reflective elements can be reduced.

When a plurality of toners are used and besides the light emitting portion and photo sensing portion have non-linear characteristics, the correction based on only two measurement points can not be expected to produce exact result. In accordance with the second aspect of the invention, since it is possible to obtain correction values at appropriately selected operating points suited to typical density values of plural toner images to be measured, it is possible to achieve precise correction for the toners having different values of reflectance.

In the third and fourth configurations of the invention, the first and second intensities of emitted light are set so as to fall within the sensitive range of the photosensor and the first intensity of emitted light is set greater than the second intensity of emitted light. Therefore, it is possible to determine the sensor correction value in the region close to the operating point of the sensor on the occasion of actual measurement of the density of a toner image, and hence achieve precise correction.

In the fifth and sixth configurations of the invention, a reflective element is used as the background for the measurement of the density of black toner, an extra element as the background for measuring the density of the black toner image is not needed; there is no need to provide a separate element. Since color toners have high values of reflectance, the background for them is adapted to have a higher reflectance than those. As a result, it is possible to select characteristic points so as to permit pertinent correction for all the toners.

In the seventh and eighth configurations of the invention, even if the density of a toner image produced under the same image forming conditions varies due to various causes in the image forming system, it is possible to constantly obtain stable sensor correction values because the sensor correction values are determined within the range near the density to be measured.

In the ninth and tenth configurations of the invention, at least one of the image forming conditions is controlled so that the density of a toner image is adjusted so as to provide an intensity of received light from the toner image, which is close to the intensity of received light from the reflective element when the reflective element is illuminated with the second intensity of emitted light. As a result, it is possible to avoid a density of the toner image varying or deviating remarkably from the expected density of toner image in correcting the sensor characteristics, thus it is possible to constantly produce a stable sensor correction value.

In the eleventh and twelfth configurations of the invention, since the first and second intensities of light are measured at the same position in the reflective element, it is possible to achieve stable correction to the measurement even if the reflective element has unevenness in its reflectance.

In the thirteenth and fourteenth configurations of the invention, since a plurality of measurements are averaged to determine a correction value, the correction will not be affected by the influence of unevenness in reflectance.

BRIEF DESCRIPTION OF THE DRAWINGS

FIG. 14 is a relational table showing the relationship between storage values D and reference values for measurement;

DESCRIPTION OF THE PREFERRED EMBODIMENTS

The embodiment of the invention will be described hereinbelow with reference to the drawings.

Figure 1:
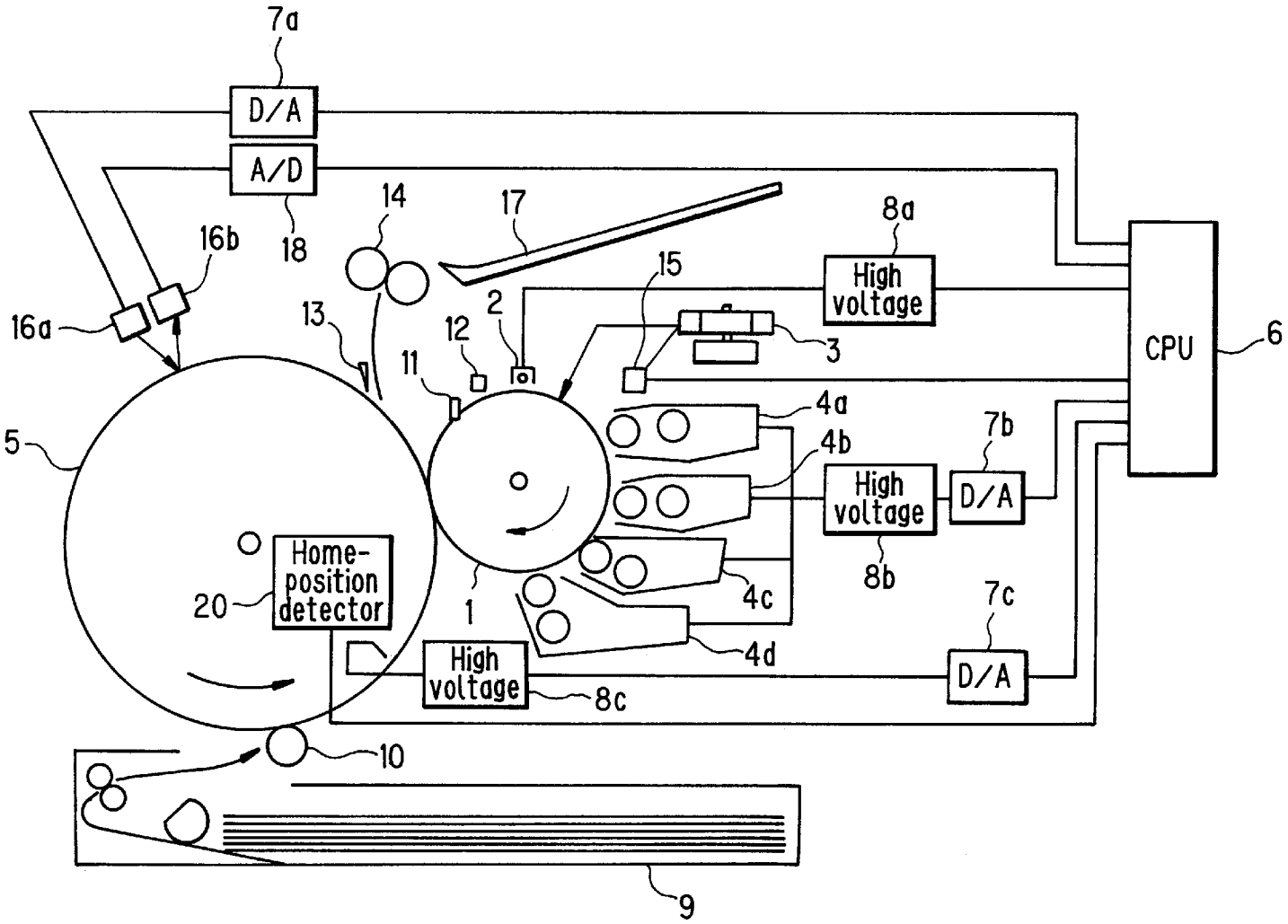
FIG. 1 is a schematic sectional view showing a color printer using an image forming apparatus with a toner density measuring function in accordance with the invention.

FIG. 1 is a schematic sectional view showing a color printer using an image forming apparatus with a toner density measuring function in accordance with the invention. A photoreceptor 1 is rotated in the direction of the arrow in the figure by means of an unillustrated stepping motor. Photoreceptor 1 charged at a prescribed voltage by a charger 2 is illuminated by laser beams from LSU (laser scanning unit) 3, forming an electrostatic latent image. Arranged on the downstream side of the exposure position are four developing units for yellow, magenta, cyan and black (4*a*, 4*b*, 4*c* and 4*d* respectively) in this sequential order. One of these units is selectively operated for each exposure operation to perform development. A transfer drum 5 is rotated in the direction of the arrow in the figure at the same peripheral speed as that of photoreceptor 1 by means of the motor which drives photoreceptor 1. CPU 6, D/A converter 7*c* and transfer high-voltage power source 8*c* are provided so that an arbitrary voltage can be applied to transfer drum 5.

The paper fed from a sheet cassette 9 is wound around transfer drum 5 with the function of a roller 10. The toner image formed on photoreceptor 1 is transferred at the contact between photoreceptor 1 and transfer drum 5 to the sheet on transfer drum 5, while leftover toner which has not been transferred is removed by a photoreceptor cleaner 11 and unnecessary charge is eliminated by an erasure lamp 12.

For color printing, whilst a sheet is wound around transfer drum 5, a required number of processing operations comprising charging, exposure, development, transfer, cleaning and charge erasure are executed so as to lay over multiple colors on the sheet. In general, as soon as four colors have been laid over one another, the sheet is separated by separation claws 13 and is conducted to a fixing unit 14 and then is discharged to a sheet output tray 17.

As will be described later, when the toner image is transferred to transfer drum 5 as an image forming portion, if characteristic variations of the toner density needs to be corrected, the toner image formed on photoreceptor 1 is directly transferred to the surface of transfer drum 5 which has no sheet thereon. The density of the toner image is measured to perform correction to the toner density. At the next stage, printing, a laser control signal in accordance with the text or pictorial data to be printed is supplied from an unillustrated image controller to a laser 15. Control of laser 15 can be performed from a CPU 6 so that laser 15 can also be turned on and off in synchronization with the rotation of LSU 3. Thus, the control of CPU 6 enables formation of a static latent image only in a prescribed portion on photoreceptor 1.

Each developing unit 4*a*, 4*b*, 4*c* and 4*d* is adapted to have an arbitrary developing bias voltage applied through a D/A converter 7*b* from CPU 6. A high-voltage power source 8*a* connected to charger 2 is controlled directly from CPU 6 so as to be turned on and off. A toner density sensor for measuring the toner image density on transfer drum 5 is arranged facing transfer drum 5. This toner density sensor is made up of a light emitter 16*a* and a photosensor 16*b*. Light emitter 16*a* is connected to a D/A converter 7*a*, photosensor 16*b* being connected to an A/D converter 18, so that control of the intensity of emitted light and reading of the intensity of received light can be carried out from CPU 6.

Figure 2:
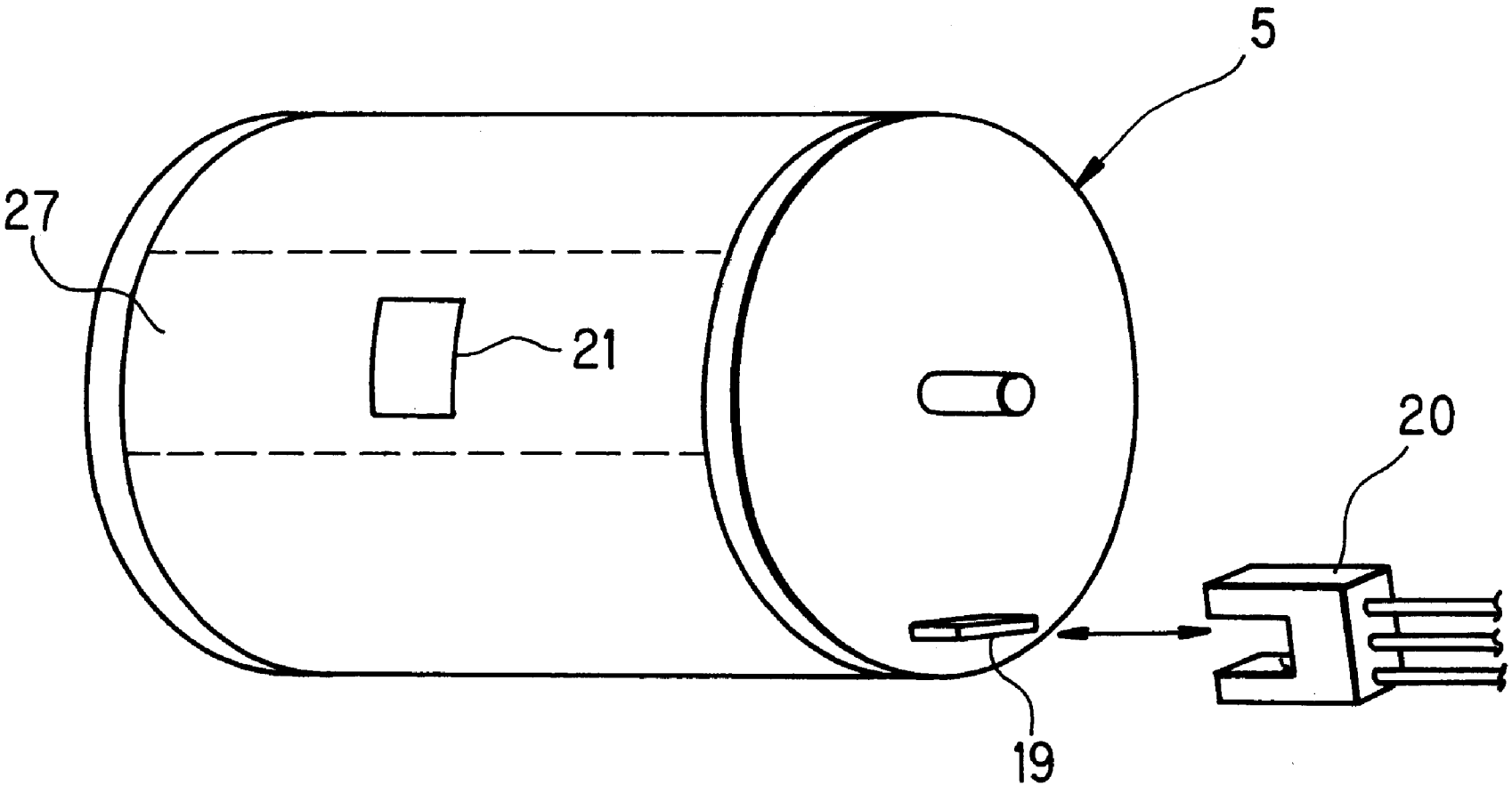
FIG. 2 is a perspective view showing the transfer drum portion.

FIG. 2 is a perspective view showing the transfer drum portion. An actuator 19 is provided on a side face of transfer drum 5 so that, as transfer drum 5 makes one revolution, actuator 19 will act as a shade in the gap between the photosensor and light emitter of a transfer drum home-position detector 20 which is arranged at a position facing a side face of transfer drum 5. CPU 6 is adapted to detect the rotational position of transfer drum 5 from the change in the output from transfer drum home-position detector 20.

The cylindrical surface of transfer drum 5 is made black to allow the measurement of the density of a color toner image transferred on the surface thereof. A white-coated area 21 as a reference for correction to toner density sensors 16*a* and 16*b* and for measurement of a black toner image, is provided on the cylindrical surface of transfer drum 5 at a position having a certain positional relationship relative to actuator 19. White-coated area 21 is located in a non-image area 27 on transfer drum 5.

Figure 3:
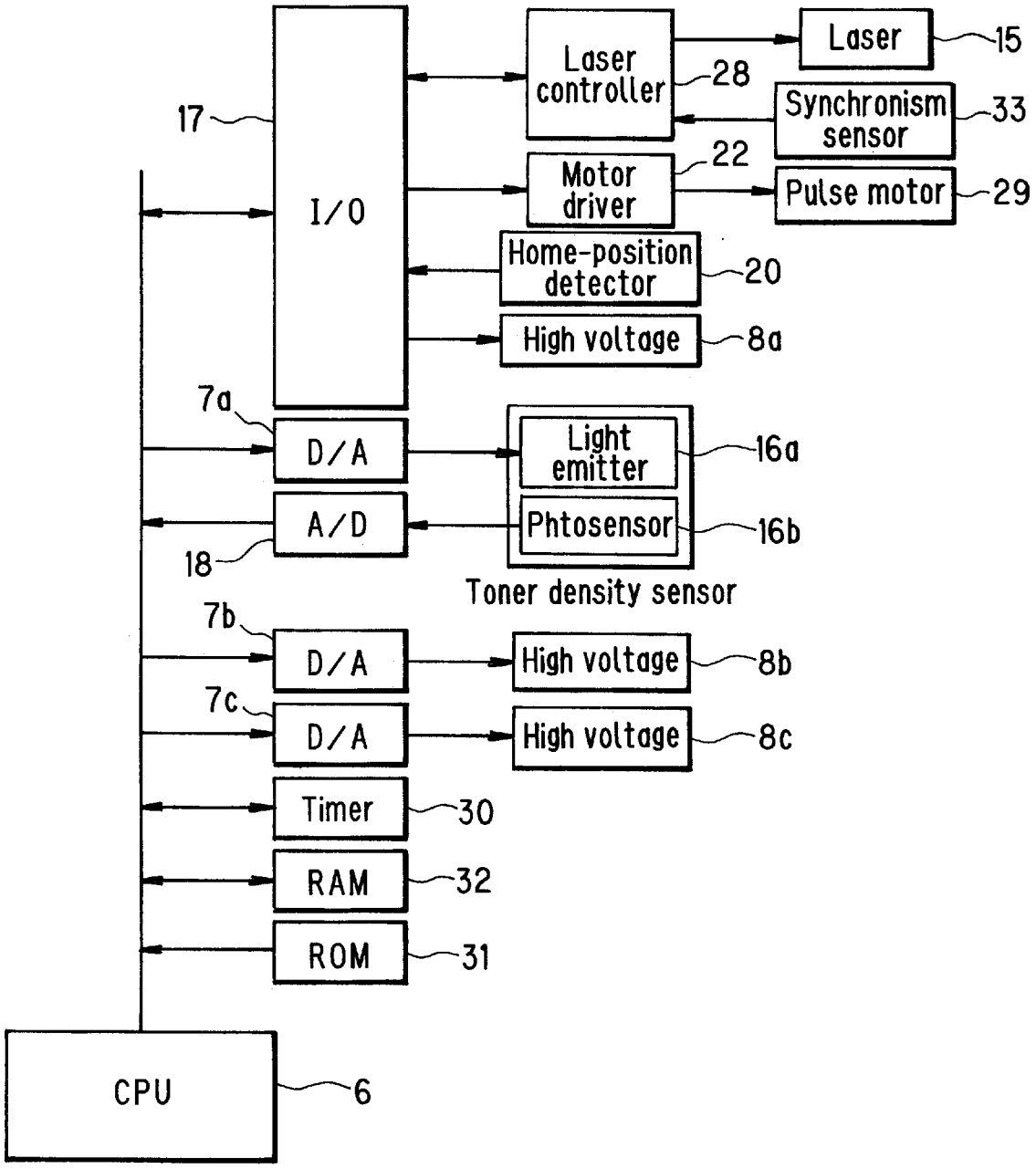
FIG. 3 is a schematic block diagram showing peripheral circuits of a CPU.

FIG. 3 is a schematic block diagram showing peripheral circuits of CPU 6. An I/O port 17 is connected to: a laser control block 28 which in turn is connected to laser 15 and a synchronism sensor 33 for a polygon mirror provided in LSU 3; a motor driver 22 which in turn is connected to a driver pulse motor 29 for photoreceptor 1 and transfer drum 5; a high-voltage power source 8*a* for charger 2; and a transfer drum home-position detector 20.

Eight bit D/A converters 7*a*, 7*b* and 7*c* individually control the light intensity of toner density sensing light emitter 16*a*, the output from a high-voltage power source 8*b* for developing bias voltage, and the output from a transfer high-voltage power source 8*c*, respectively. The output from toner density sensing photosensor 16*b* is connected to 8 bit A/D converter 18 so that CPU 6 can read the intensity of received light. A timer 30 is adapted to cut in the process of CPU 6 at regular intervals, so that CUP 6 can readily detect the rotational position of transfer drum 5 based on the lapse of time from the detection of the signal from transfer drum home-position detector 20. A ROM 31 stores control programs, various control parameters and a program for sensor correction which will be described hereinbelow in relation to all the embodiments. A RAM 32 is used as a work area and the like for program execution.

Figure 4:
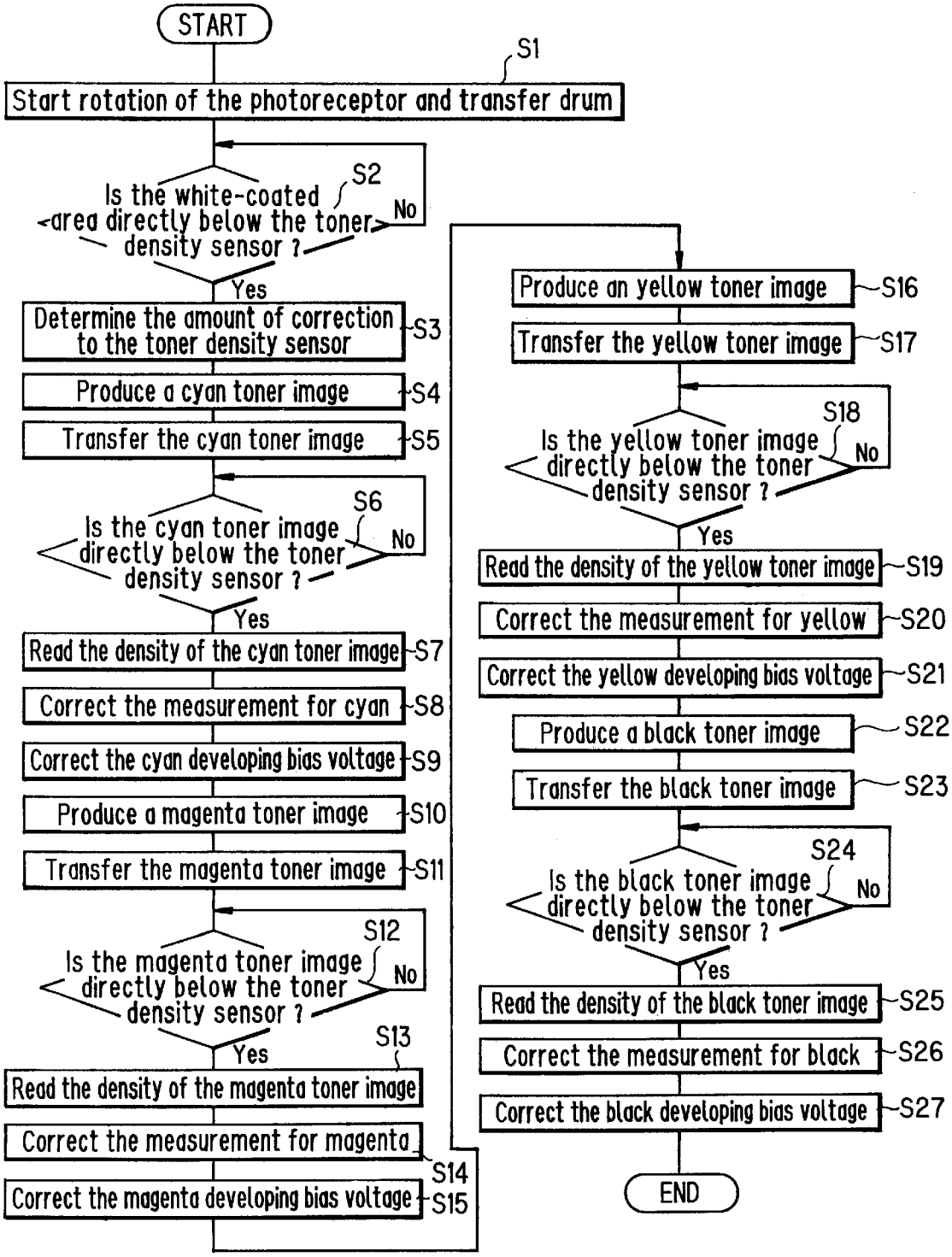
FIG. 4 is a flowchart showing a schematic procedure of operation in the color printer for correcting variations in the characteristics of the image forming process due to surrounding conditions, etc.

FIG. 4 is a flowchart showing a schematic procedure of operation in the printer having the above configuration for correcting variations in the characteristics of the image forming process due to surrounding conditions etc. Photoreceptor 1 and transfer drum 5 are started to rotate (S1). When white-coated area 21 reaches the position of the toner density sensor (S2), the amount of correction to toner density sensor 16*a* and 16*b* is determined (S3). Three patches of static latent images of some cm square are formed by making ON/OFF switching control of the laser and are developed with cyan toner forming a toner pattern (S4). During this operation, three levels of developing bias voltages each differing 50 V from other are sequentially applied to cyan developing unit 4*c* so that the three patches of latent image are developed into a toner pattern by three levels of different developing bias voltages.

Then, the three patches of the cyan toner pattern are transferred from photoreceptor 1 to transfer drum 5 (S5). When these patches travel directly below the toner density sensor (S6), the A/D converted values of the outputs from photosensor 16*b* are successively read (S7). Then, the A/D converted values are corrected (S8), and based on the corrected result a correction value to the developing bias voltage to be applied to the cyan developing unit is calculated (S9). The same operation from S4 to S9 is repeated for magenta, yellow and black (S10 to S27).

The above operation is performed by transferring black toner to white-coated area 21 and by transferring cyan, magenta and yellow toner to an area (i.e., black area) other than white-coated area 21 on transfer drum 5.

Figure 5:
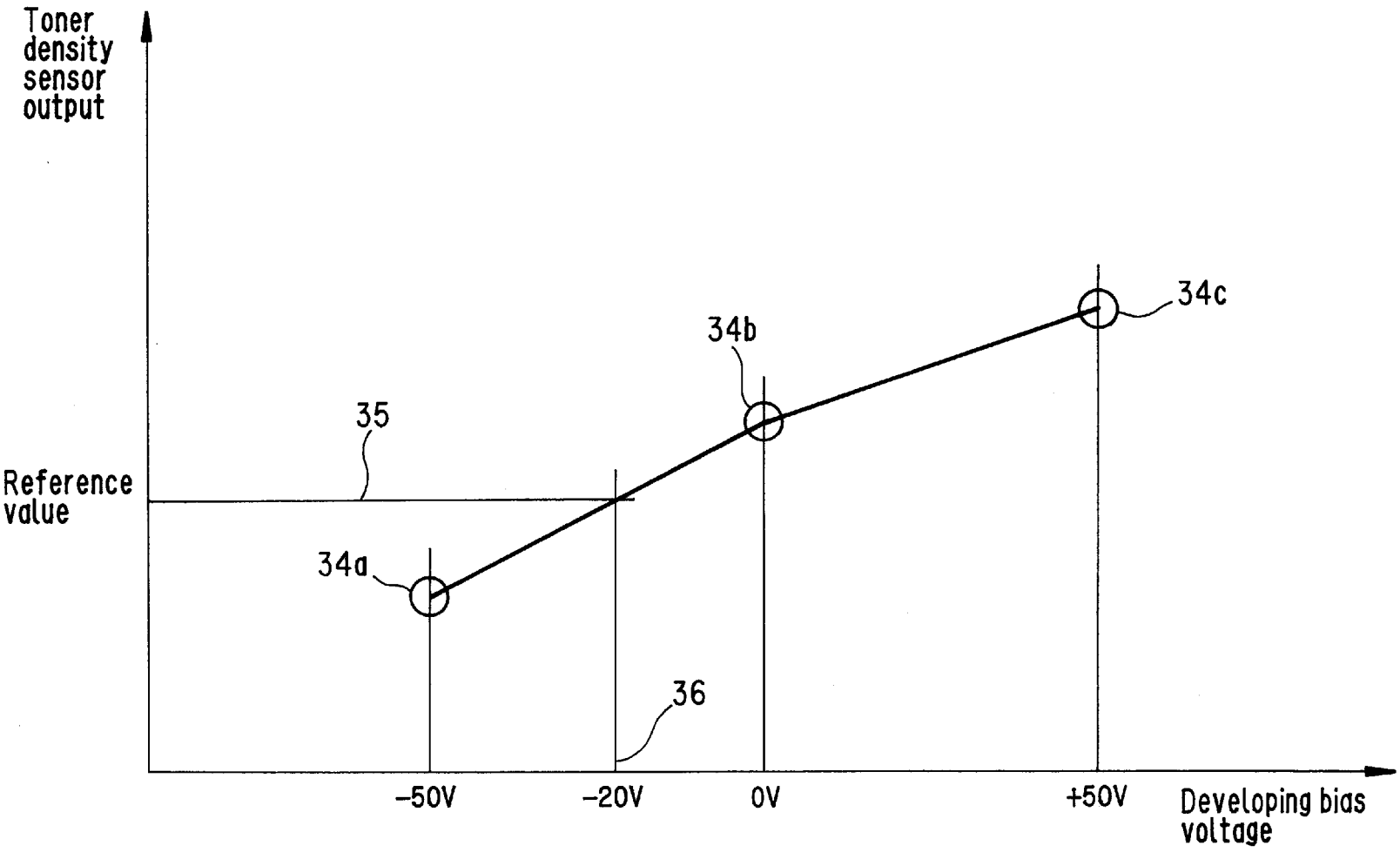
FIG. 5 is a chart showing for illustrating the calculation for the bias voltage correction in the process correction.

There are various method for calculating the correction value to the developing bias voltage. Here in this case, as shown in FIG. 5, three sensor outputs 34*a*, 34*b* and 34*c* (the values after the aforementioned correction) of toner density, obtained for the different three levels of developing bias voltages are used to determine a developing bias voltage 36 which will correspond to a predetermined reference value 35, and this is set as the developing bias voltage for image forming. In FIG. 5, the sensor output equal to the reference value was obtained at a voltage 20 V lower than the developing bias voltage when the toner image was created. Therefore the developing bias voltage for image forming may and should be reduced by 20 V.

First Embodiment

Next, description will be made on the first embodiment of a means for correcting the measurement value of toner density.

Figure 6:
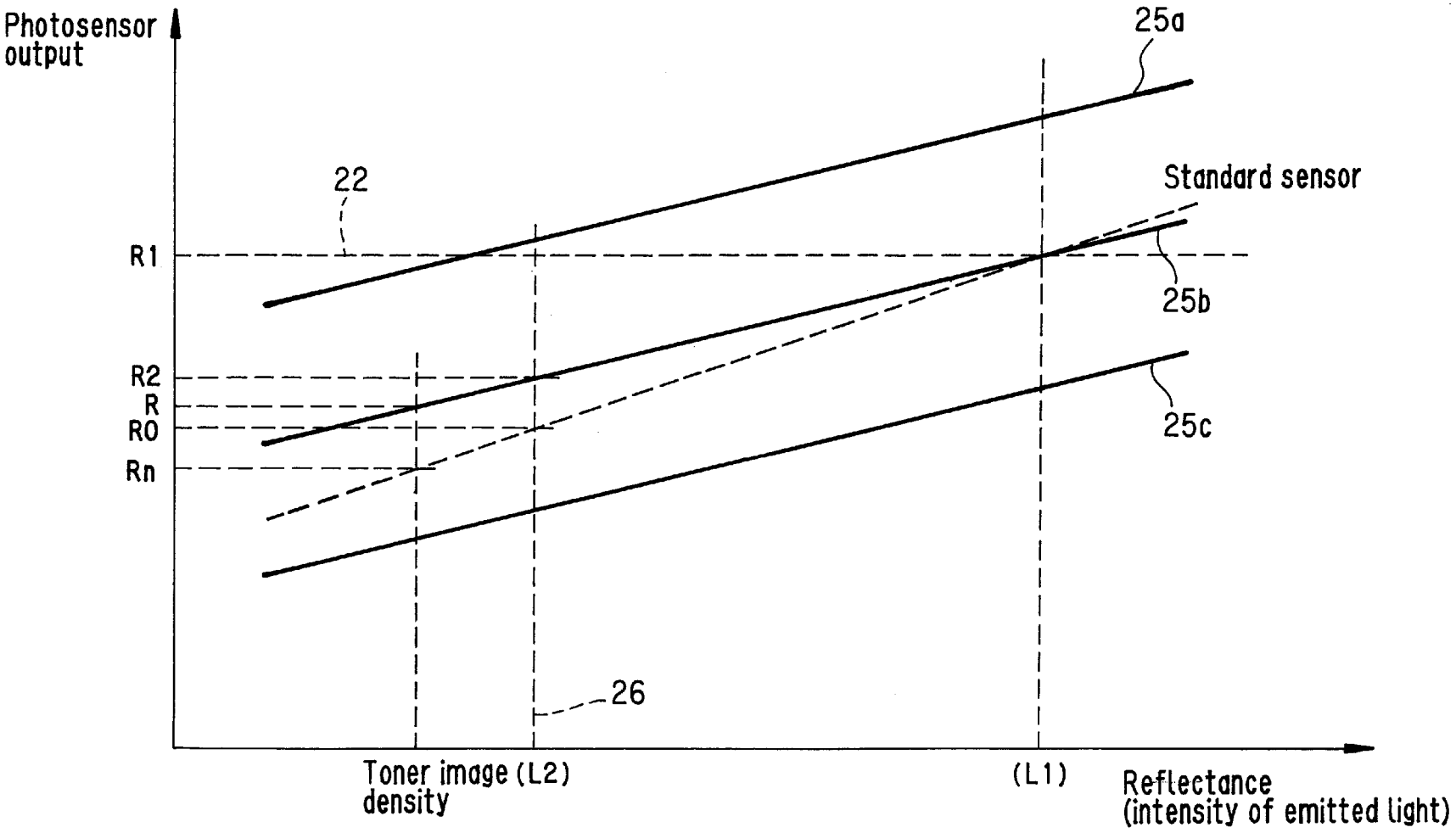
FIG. 6 is a chart schematically showing the characteristics of a toner density sensor in the first embodiment.

FIG. 6 is a chart schematically showing the characteristics of a toner density sensor. The abscissa represents a reflectance in the measured portion and the ordinate represents the output from photosensor 16*b*. The reflectance along the abscissa is correlated to the toner density while the output from photosensor 16*b* is the output value from A/D converter 18. Here, the toner density sensor is assumed to have linear characteristics.

Concerning the toner density sensor, the intensity of received light in photosensor 16*b* will change depending upon the intensity of emitted light from light emitter 16*b*. Therefore, if the intensity of emitted light is made different as shown by 25*a*, 25*b* and 25*c* in FIG. 6, the output characteristics of the photosensor with respect to the intensity of reflected light which corresponds to the reflectance will become different. To deal with this, based on the intensity of received light from white-coated area 21 as the reference, the characteristics of the toner density sensor are set up. Specifically, the characteristics of the toner density sensor are set up by measuring the intensity of received light at photosensor 16*b* whilst varying the output power (the D/A converted value) from light emitter 16*a* to white-coated area 21 having a constant reflectance. In this case, the setup characteristics are assumed to be the one designated at 25*b* in FIG. 6.

Now, description will be made of a specific means of correcting the measurement value of toner density sensor.

Figure 7:
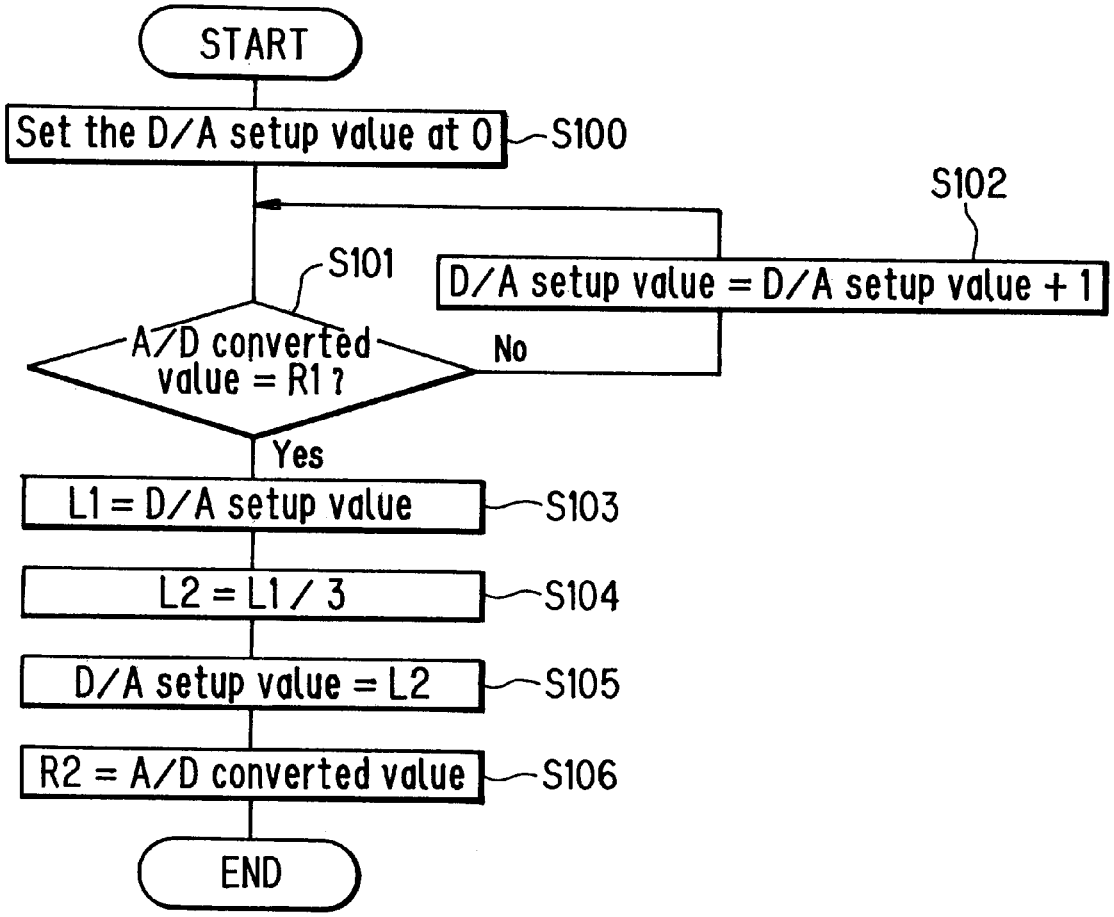
FIG. 7 is a flowchart showing a schematic procedure of the operation of setting up the characteristics of a toner density sensor using a white-coated area.

FIG. 7 is a flowchart showing a schematic procedure of the operation of correcting the characteristics of the toner density sensor using white-coated area 21 (S3 in FIG. 4). First, the output (the setup value in D/A converter 7*a*) from light emitter 16*a* is set at 0 (S100). Then, the output from light emitter 16*a* is increased until the A/D converted value of the output from photosensor 16*b* reaches an output reference value R1 (S101 and S102). When the output from photosensor 16*b* for the reflected light from white-coated area 21 having a constant reflectance has become equal to reference value R1, the setup value in D/A converter 7*a* is stored as L1 (S103). This process constitutes the first light intensity determining means. L1 determined here is the intensity of emitted light used for the measurement of toner density. Since the output from light emitter 16*a* is set as L1 so that the output from photosensor 16*b* will become equal to reference value R1, the sensor characteristics during the measurement of toner density can be made constant. Next, L1 obtained at S103 is divided by 3 and the result is set as L2 (S104). This process constitutes the second light intensity determining means. After setting up one-third of L1 in D/A converter 7*a* (S105), the A/D converted value of the output from photosensor 16*b* is read as R2 (S106).

In both cases where the intensity of the reflected light from white-coated area 21 is measured when the intensity of emitted light is at L2 and where the same intensity of reflected light from a toner image when the intensity of emitted light is set at L1, the photosensor produces the same output, i.e., R2. The characteristic line designated at 25*b* in FIG. 6 is determined by measuring the intensity of received light whilst varying the intensity of emitted light. This characteristic line 25*b* can be considered, in effect, identical to the output characteristics from photosensor 16*b* when actual measurement of toner density is performed with the intensity of emitted light set at L1.

Since the photosensor output of a toner density sensor varies due to change in surrounding conditions or the passage of time (aging), the measurement needs to be corrected in order to achieve a precise measurement. For this purpose, an A/D converted value (R0) for a standard sensor which will be obtained when white-coated area 21 is illuminated with light having an intensity of L2, should be determined in advance by experiment or other methods. Using this value, an A/D converted value R of the intensity of received light which is obtained in an actual measurement of a toner image in accordance with the procedure of FIG. 4 is corrected as Rn by the following formula:

$$Rn=R\cdot(R1-R0)-R1\cdot(R2-R0) \quad (1).$$

By the configuration and control described above, it is possible to set up the photo-sensing characteristics for white-coated area 21 as the characteristics of the toner density sensor and hence it is possible to readily correct the measurement value to an exact measurement value which would be obtained by a standard sensor. In the above, the second intensity of emitted light (L2) was set at one-third of L, but L2 can be set at any value on the basis of L1.

Second Embodiment

The second embodiment describes of a means of correcting the measurement of toner density.

Figure 8:
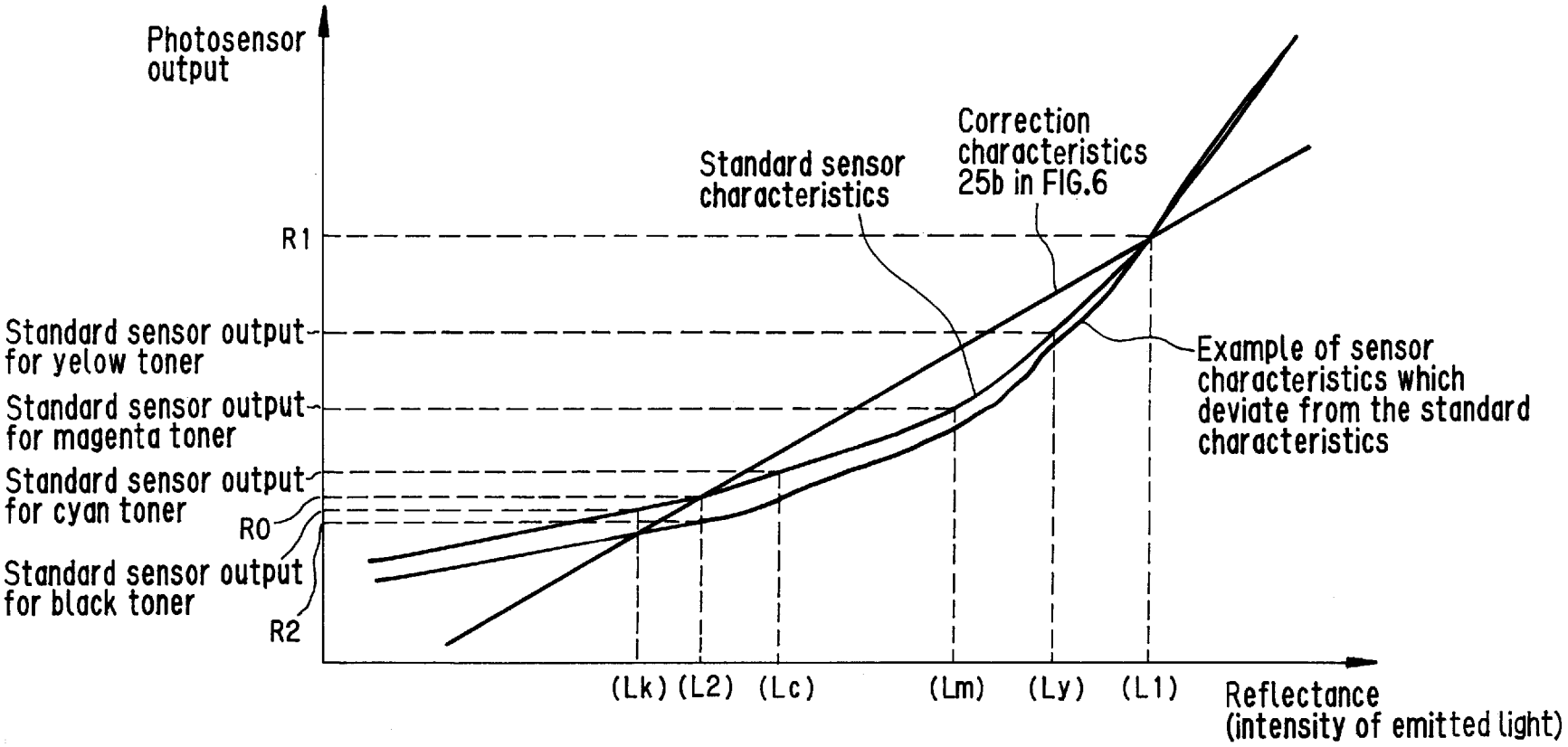
FIG. 8 is a chart schematically showing the characteristics of a toner density sensor in accordance with the second embodiment.

FIG. 8 is a chart schematically showing the characteristics of a toner density sensor in accordance with the second embodiment. When a toner image is formed on photoreceptor 1 or transfer drum 5 and its density is used to correct the characteristics of the image forming process, toner density can be measured with a higher precision when it is measured based on the state where more than a certain amount of toner is adhering to photoreceptor 1 or transfer drum 5 than when it is measured based on the state where lower amount of toner is adhering. When more than a certain amount of toner is adhering, the reflectance of a color toner image (on the black background) becomes greater than that of a black toner image (on the white background).

For color toner images, each reflectance of cyan, magenta or yellow toner differs from other; the same amount of adhering toner produces a different intensity of reflected light to photosensor 16*b*. In FIG. 6, in order to explain the characteristics of the toner density sensor and its correcting method, the sensor characteristics are shown schematically. However, actual sensor characteristics are not represented by a straight line, so that these cases need very complicated correcting formulae. In this case, the correction according to formula (1) will produce relatively exact correction values to the sensor around the density values corresponding to the first intensity of emitted light and the second intensity of emitted light but has the risk that the correction value might be markedly deviated in other ranges.

For the above reason, a method is performed, which comprises: after the determination of the first intensity of emitted light, selecting a level of the intensity of light entering the photosensor, which corresponds to a typical density of each toner image when it is measured; determining the A/D converted value of the output from photosensor 16*b* at each intensity of emitted light; and determining the amount of correction for each color. This method enables relatively exact measurement when the toner density sensor has non-linear characteristics.

Figure 9:
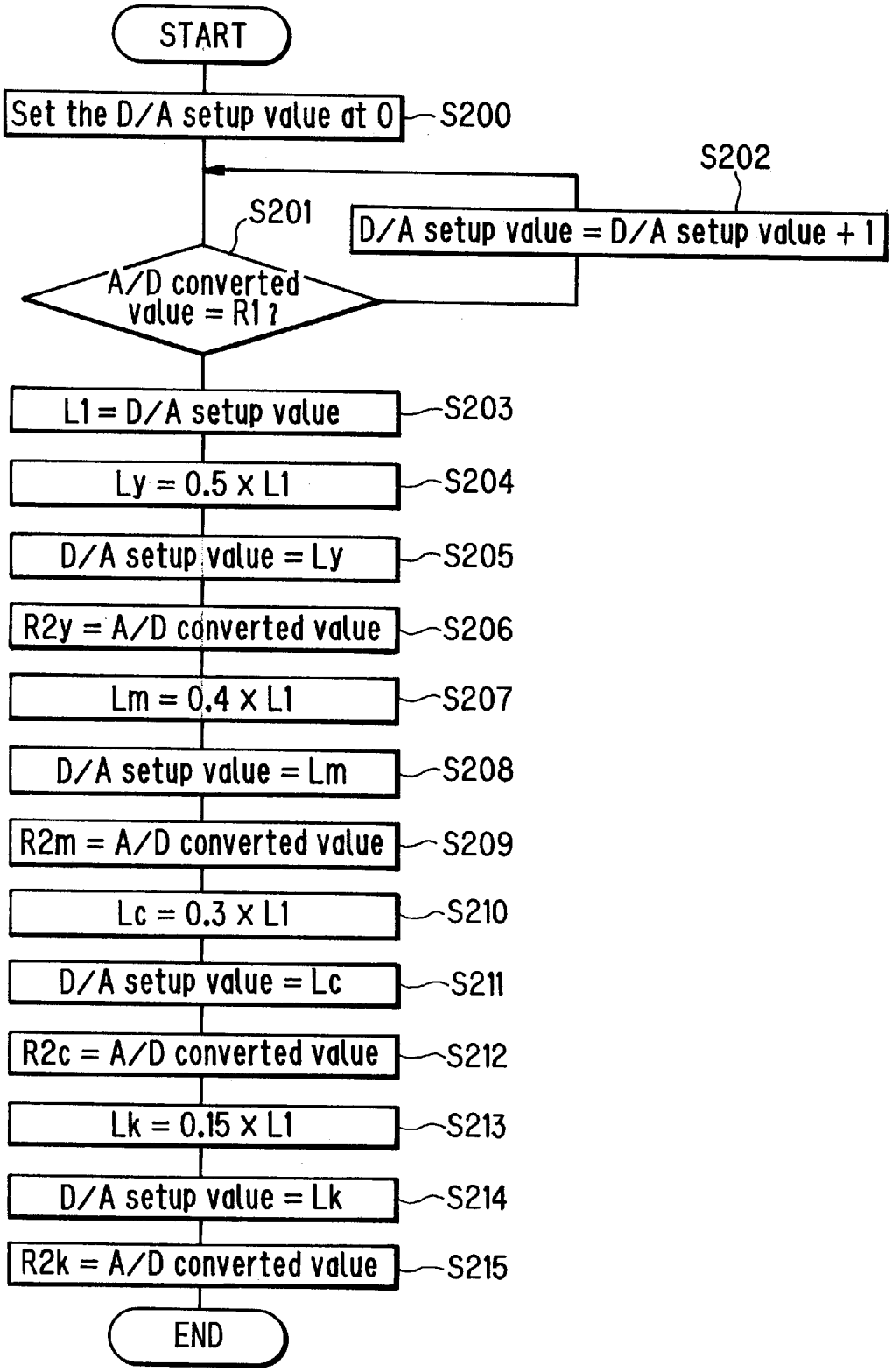
FIG. 9 is a flowchart showing a schematic procedure of determining the operation of setting up the characteristics of a toner density sensor used in the embodiment.

FIG. 9 is a flowchart showing a schematic procedure of the measurement correcting operation of a toner density sensor according to this embodiment. The determining process of the first intensity of emitted light (S200 to S203) is carried out in the same way as the steps S100 to S103 in FIG. 7. The second intensity of emitted light for yellow is set up at a level Ly=0.5×L1; the second intensity of emitted light for magenta is set up at a level Lm=0.4×L1; the second intensity of emitted light for cyan is set up at a level Lc=0.3×L1; and the second intensity of emitted light for black is set up at a level Lk=0.15×L1 (S204, S207, S210 and S213 respectively). The A/D converted values of the photosensor output when the light emitter is set at respective levels (S205, S208, S211 or S214) are stored as R2y, R2m, R2c and R2k (S206, S209, S212 or S215).

These values are used for respective colors at S8, S14, S20 and S26 in FIG. 4. The above example of calculation for correction was described based on the quotients as in formula (1). On the other hand, it is also possible to produce a precise correction as follows: that is, A/D converted values R0y, R0m, R0c and R0k at a standard sensor have been determined in advance in association with R2y, R2m, R2c and R2k, respectively; (R0y−R2y), (R0m−R2m), (R0c−R2c) and (R0k−R2k) are calculated for the respective colors of toner; and the correction is implemented following the formulae below:

$$R3y=Ry+(R0y-R2y) \quad (2\text{-}1)$$

$$R3m=Rm+(R0m-R2m) \quad (2\text{-}2)$$

$$R3c=Rc+(R0c-R2c) \quad (2\text{-}3)$$

$$R3k=Rk+(R0k-R2k) \quad (2\text{-}4).$$

This method determines the correction values to the sensor for the respective colors, at the second intensity of emitted light corresponding to the density around which density measurement will be actually implemented, and provides as precise a correction as the quotient calculation in the above first method (first embodiment) by mere addition and subtraction. Since this method needs no multiplication, this method is especially advantageous when a low processing capacity CPU 6 is used because calculation of correction values to the sensor can be easily performed with precision.

Next, description will be made of another means for correcting the measurement value of toner density in the second embodiment.

Figure 10:
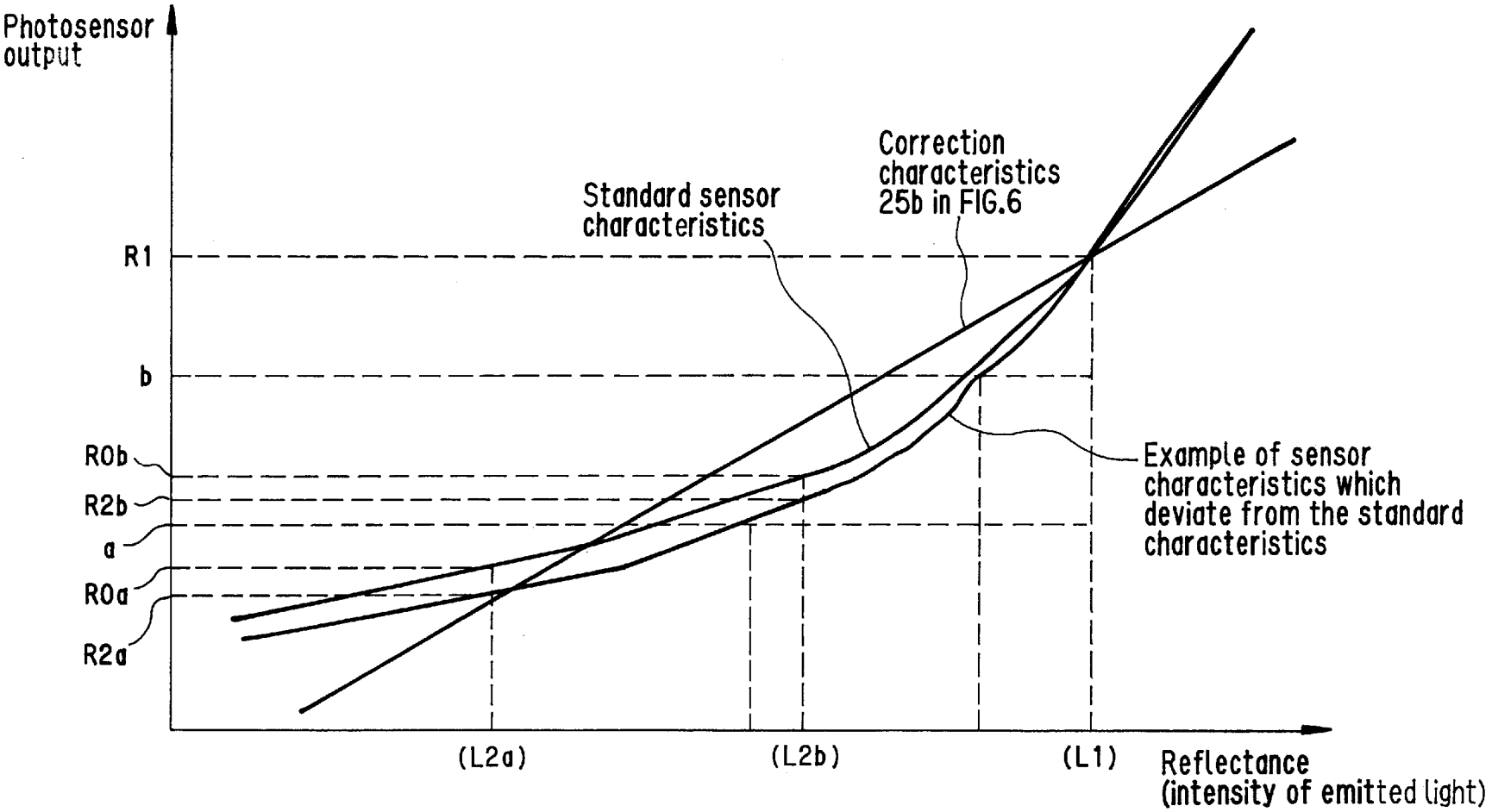
FIG. 10 is a chart schematically showing the characteristics of a toner density sensor in the second embodiment.
Figure 11:
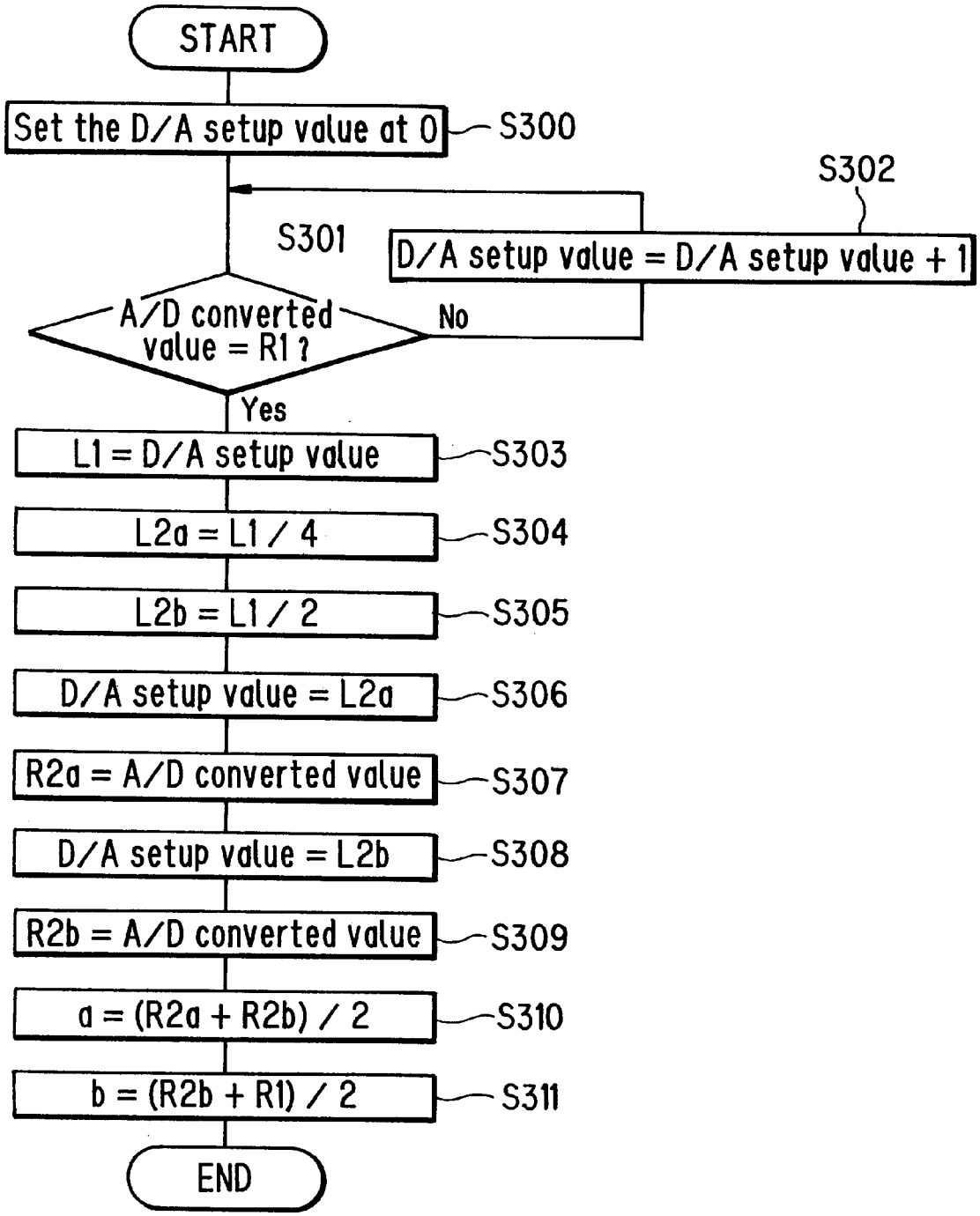
FIG. 11 is a flowchart showing a schematic procedure of determining the operation of setting up the characteristics of a toner density sensor used in the embodiment.

FIG. 10 is a characteristic chart of a toner density sensor in the second embodiment. This sensor has the same sensor characteristics as that in FIG. 8. For two levels of the second intensities of emitted light L2a and L2b, the intensities of the reflected light from white-coated area 21 are read and stored as R2a and R2b, respectively. FIG. 11 is a flowchart showing the schematic procedure of determining the correcting value for the toner density sensor of this embodiment. Steps S300 to S303 are the same as Steps S100 to S103 in FIG. 7. Determined at S303 is the first light intensity L1, and based on this, a quarter of it is set as L2a and a half of it is set as L2b (S304, S305).

L2a is set at D/A converter 7*a* (S306) and the A/D converted result of the photosensor output is read and set as R2a. (S307). In a similar manner, for L2b, the A/D converted result of the photosensor output is read and set as R2b (S308 and S309). Then, the following 'a' and 'b' is calculated and stored (S310 and S311):

$$a=(R2a+R2b)/2 \quad (3\text{-}1)$$

$$b=(R2b+R1)/2 \quad (3\text{-}2),$$

where R1 is the output value (22 in FIG. 6) from the standard sensor used in the first light intensity determining means. Reference values R0a and R0b should be determined, in advance, in relation to R2a and R2b respectively.

Figure 12:
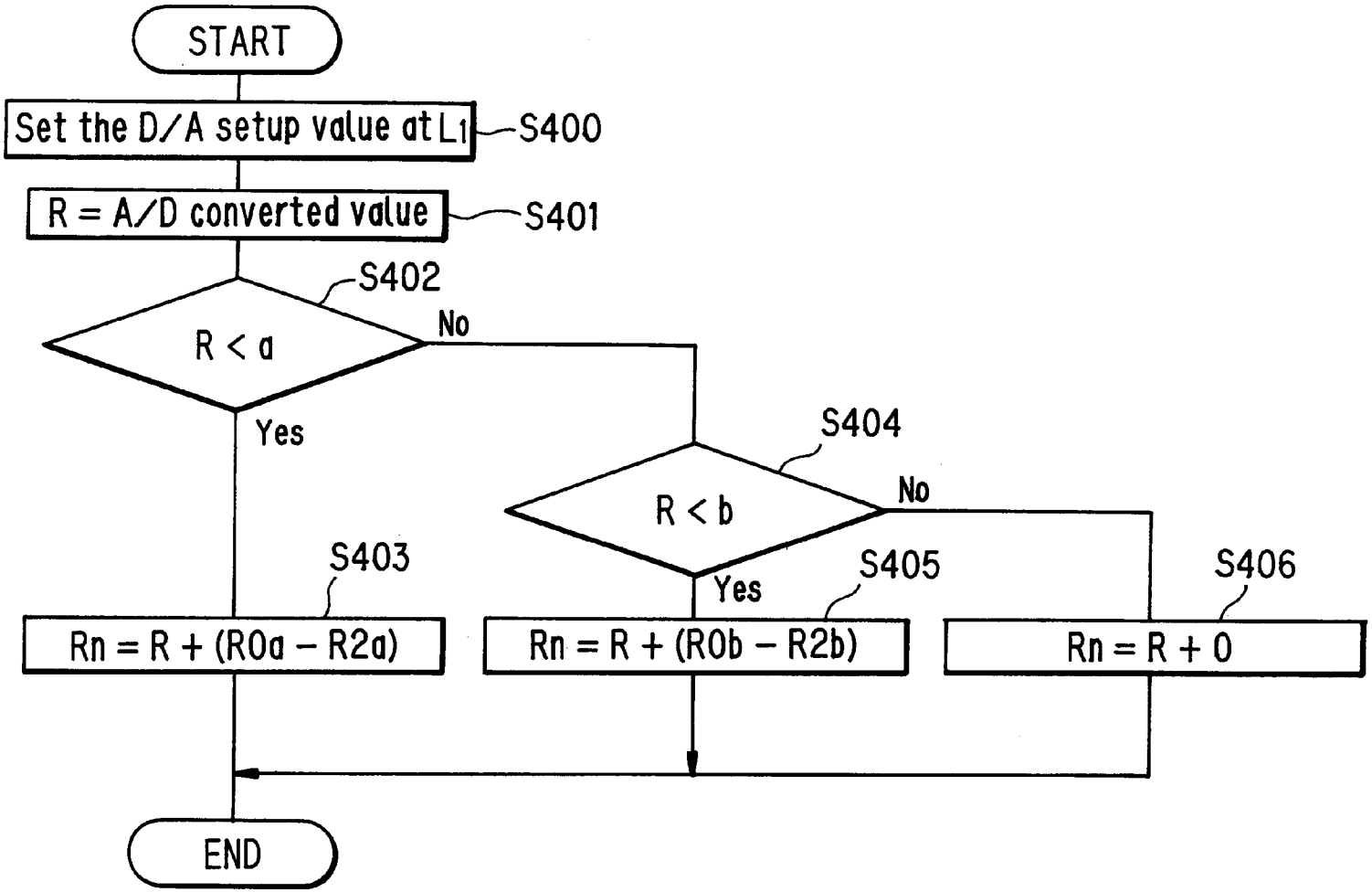
FIG. 12 is a flowchart showing a schematic procedure of the operation for correcting the variations in the characteristics of the image forming process.

This embodiment differs from the schematic procedure for correcting the variations in the characteristics of the image forming process shown in FIG. 4, in S8, S14, S20 and S26 in FIG. 4. FIG. 12 shows the substitution for these steps, which is common to all the operations for the different colors. That is, this operation comprises the steps of: measuring the density of toner (S400 and S401); comparing the A/D converted value with 'a' and then 'b' (a<b) (S402 and S404); setting the sensor correction value, at (R0a−R2a) if the A/D converted value is equal to or below 'a' (S403), at (R0b−R2b) if it is between 'a' and 'b' (S405) and at 0 if it is equal to or above 'b' (S406) and adding the set value to the measurement value. The values 'a', 'b', R2a and R2b are those determined in accordance with FIGS. 10 and 11. When R is equal to or above 'b', the correction value is set at 0 because the toner density is closer to the intensity of received light which will be obtained with the first intensity of emitted light. In this way, when the toner density is measured, the correction value is determined in accordance with the measured density. Thus it becomes possible to constantly produce an exact correction value even when the sensor has non-linear characteristics as shown in FIG. 10.

Third Embodiment

Next, description will be made of a means for correcting the measurement value of a toner image density of the third embodiment.

As already described. 8 bit A/D converter 18 and D/A converter 7*a* are connected to the toner density sensor. The 8 bit converter can produce 256 levels of output, i.e., 0 to 255, which might not be sufficient for high precision measurement. To overcome this situation, it is necessary to set the first intensity of emitted light at as high as possible in order to assure a high enough accuracy. However, if the second intensity of emitted light is greater than the first intensity of emitted light, there is a risk that overflow will occur. When the second intensity of emitted light is 0 or close to 0, it is impossible to make exact measurement due to noise in the photosensor. Therefore, it is necessary to limit the measurement values to within the range of the photo sensing capacity.

Reference value R1 for determining the first intensity of light is set at 200, which is high enough relative to 8 bits. In this case, the circuit is designed that setup value L1 at D/A converter 7*a* connected to the light emitter is approximately 180. In the calculation for obtaining one-third of L for the second intensity of emitted light, some error occurs because the calculation is limited to an integer, but the error can be suppressed within about ±1. The intensity of received light from white-coated area 21 with the second intensity of emitted light is about 65, represented in the scale of A/D converted values, which is adapted to approximately correspond to the toner density to be measured. No noise will affect the measurement when the intensity of received light is about 65.

In this way, since the first intensity of emitted light used for actual measurement is set at a level close to the limit of the setup capacity of photo sensing while the second intensity of emitted light is set at a level greater than 0 and smaller than the first intensity of emitted light, it is possible to perform the measurement within the range of the measuring capacity and hence make correction with a relatively high accuracy even when 8 bit A/D converter 18 and D/A converter 7*a* are used.

Fourth Embodiment

Next, description will be made of a means for correcting the measurement value of a toner image density of the fourth embodiment.

In general, in color printers or the like which use color toners and a black toner, the toner density of a color toner is measured by using a toner image formed on the black background while the toner density of black toner is measured by using a toner image formed on the white background as stated above. This provides measurements with good precision. Therefore, on the occasion of effecting correction to the toner density sensor, if measurement for correction can be implemented using either the black background or the white background (white-coated area 21), no extra reference density element is needed.

Since in the case of the black background, lesser level of the reflected light will be detected at the photosensor, the measurement for correction is performed in effect using the white background. Setting the reflectance of the white background (white-coated area 21) at a level higher than that of the color toners, assures the first intensity of emitted light will be high enough, and hence it becomes possible to achieve high-precision correction for measurement of density for all the colors of toner.

Fifth Embodiment

Next, description will be made of a means for correcting the measurement value of a toner image density of the fifth embodiment.

Figure 13:
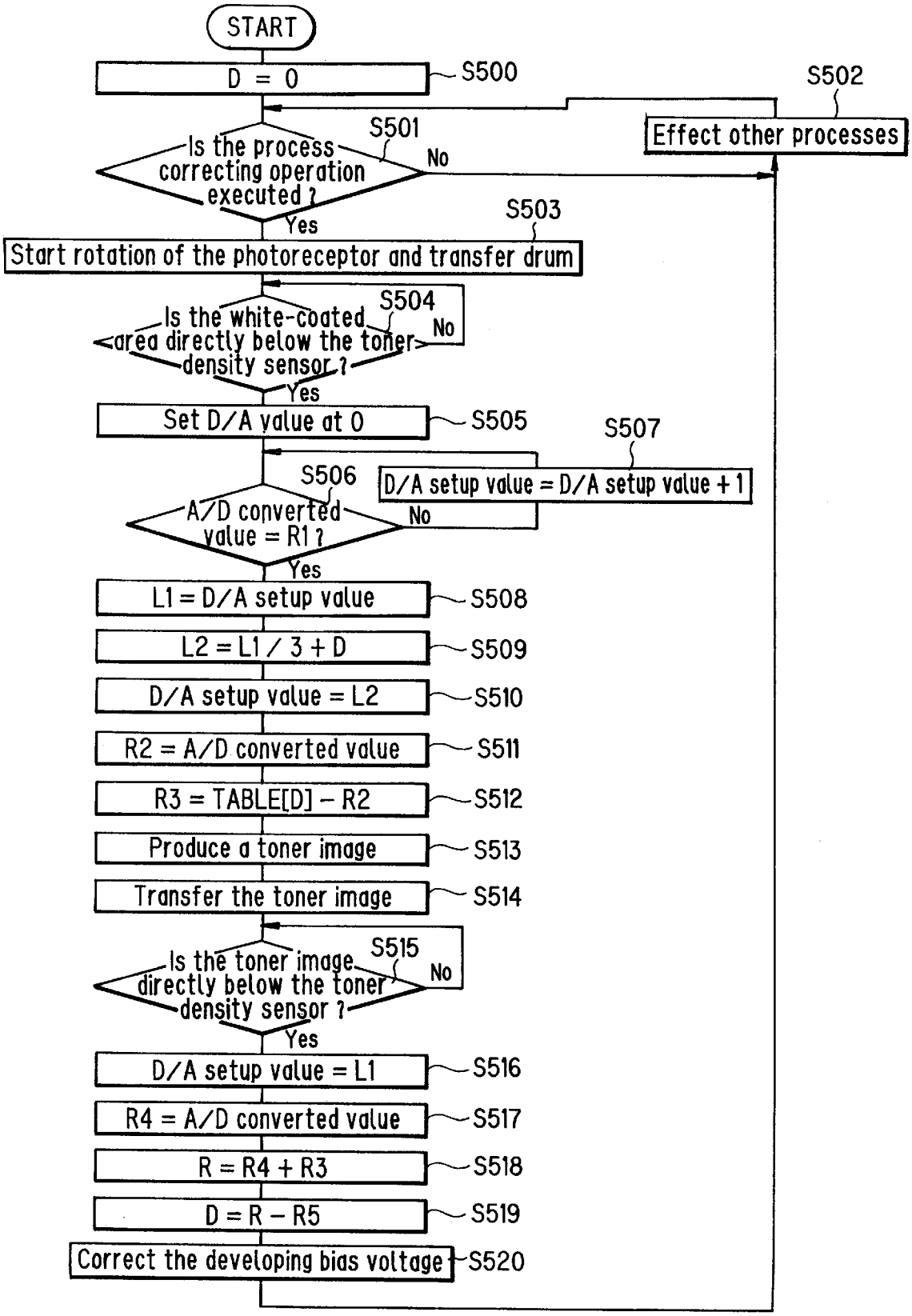
FIG. 13 is a flowchart showing a schematic procedure of the operation of correcting the toner density sensor and the process correcting operation in accordance with the fifth embodiment.

FIG. 13 is a flowchart showing a schematic procedure of the operation of correcting the toner density sensor and the process correcting operation in accordance with this embodiment. The description hereinbelow will be made with regards to one color of toner, but the same operation can be applied to plural colors of toner. In this embodiment, a storage value D is introduced so that the characteristic setup point of the toner density sensor is made to approach the actual measuring point of toner density. This will be detailed hereinbelow.

When the power to the color printer is turned on, storage value D is initialized (S500). When conditions for executing the process correcting operation are met (S501→S503), photoreceptor 1 and transfer drum 5 etc. start rotating (S503). When white-coated area 21 arrives at the position of the toner density sensor (S504), the correction of the toner density sensor is executed (S505 to S511). Steps S505 to S508 are identical to Steps S100 to S103 in FIG. 7. Then, the second intensity of emitted light L2 is set at L1/3+D (S509) and is set up in D/A converter 7*a* (S510). At this moment, storage value D is zero, therefore the second intensity of emitted light L2 is L1/3 and this is set up in D/A converter 7*a*.

Storage value D designates the second intensity of emitted light L2, varying from −6 to +6. Stored in ROM 31 is the A/D converted value (reference value) of the standard sensor when the second intensity of emitted light L2 (L1/3+D) set up by storage value D is used. This is shown in FIG. 14. In accordance with storage value D, a reference value is read from TABLE in FIG. 14, and its difference from the A/D converted value R2 for white-coated area 21 when the light is emitted at L2 is used to determine the sensor correction value R3 (S511). For example, at the beginning, D is zero so that TABLE [0]=60 is selected and the correction value R3 becomes equal to 60−R2 (S512). From S512 to S518, a toner image is formed so that its density is measured and read as a measurement R4, while the first intensity of emitted light L1 is set, and R3 is added to R4 in order to correct sensor variations.

Then, based on a reference value R5 which has been determined beforehand by experiment and the corrected toner density R, storage value D (R-R5) to be used for the next correcting operation is determined (S519). Based on the toner density R, the developing bias voltage is corrected (S520) and other processes (the printing process etc.) are performed (S502). When conditions for executing the process correcting operation are next met (S501→S503), the second intensity of emitted light is corrected based on the corrected storage value D and the above operation is implemented. Thus, by the execution of the control described above, the intensity of emitted light is shifted closer to the conditions under which the toner density will be actually measured when the toner density sensor is next corrected. Thus, this configuration enables constant achievement of stable sensor correction.

Sixth Embodiment

Next, description will be made of a means for correcting the measurement value of a toner image of the sixth embodiment.

Figure 15:
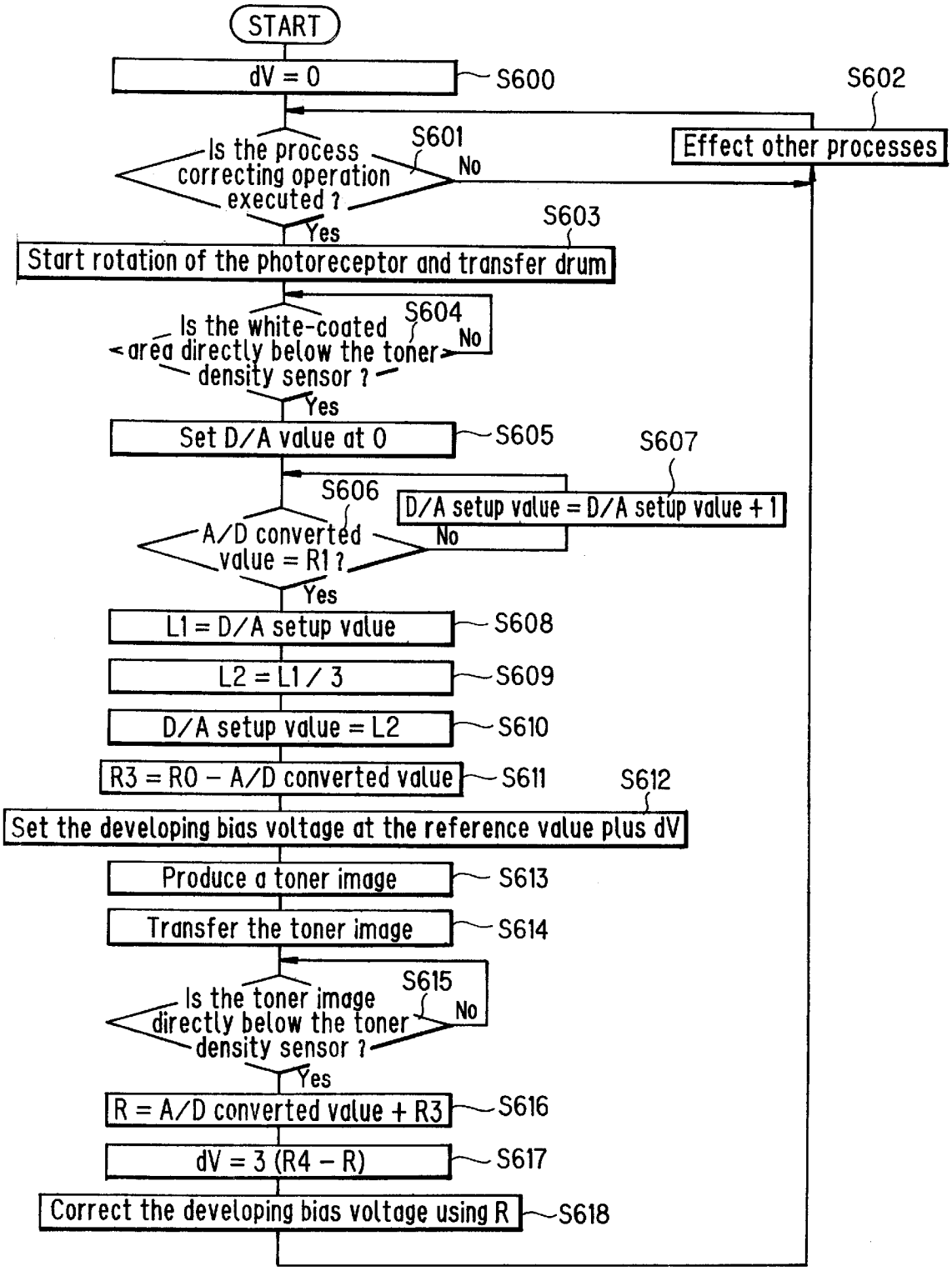
FIG. 15 is a flowchart showing a schematic procedure of the operation of correcting the toner density sensor and the process correcting operation in accordance with the sixth embodiment.

FIG. 15 is a flowchart showing a schematic procedure of the operation of correcting the toner density sensor and the process correcting operation in accordance with the sixth embodiment. The description hereinbelow will be made with regards to one color of toner. For plural colors of toner, a similar operation can be performed by setting up plural storage values dV for correcting respective developing bias voltages, in conformity with the number of toners.

When the printer is turned on or any other equivalent event occurs, storage value dV is initialized or set at zero (S600). When conditions for executing the process correcting operation are met (S601–S603), photoreceptor 1 and transfer drum 5 etc. start rotating (S603). When white-coated area 21 arrives at the position of the toner density sensor (S604), the correction to the toner density sensor is executed (S605 to S611). Steps S605 to S608 are identical to Steps S100 to S103 in FIG. 7. Then, the second intensity of light L2 is set at L1/3 (S609) and is set up in D/A converter 7*a* (S610). Based on the difference between A/D converted value R0 obtained by a standard sensor and actual photosensor output R2 for the reflected light from white-coated area 21, correction value R3 is calculated (S611).

Steps S612 to S615 are executed for the measurement of toner density. At S612, dV is added to the reference value of the developing bias voltage. At the beginning, dV is zero but at S617, it is corrected in accordance with the measured toner density. At S616, reading of the toner image density and correction for sensor fluctuation are effected. Based on a reference value R4 which has been determined beforehand by experiment and corrected toner density R, correction value dV for the developing bias voltage to be used for the next correcting operation is calculated (S617). The correction value to the bias voltage may and should be determined beforehand by experiment etc. Here, the bias voltage is adapted to be corrected by 3 V when the A/D converted value of the sensor output varies the level of 1 unit.

When conditions for executing the process correcting operation are next met (S601→S603), the developing bias voltage during forming a toner image is corrected based on the corrected dV. Therefore, the toner image density approaches a level of density which corresponds to the state case where the sensor has been properly corrected, thus making it possible to constantly achieve a stable sensor correction. Correction to the developing bias voltage at S618 is to set up a developing bias voltage during actual printing, and this can be performed using the aforementioned method described when referring to FIG. 5 or other methods. In the above description, although the method of varying the developing bias voltage was discussed, settings other than this, such as the exposure, the quantity of static charge, etc. can be controlled in accordance with parameters which are to be controlled in correcting the process characteristics.

Seventh Embodiment

Next, description will be made of a means for correcting the measurement value of a toner image density of the seventh embodiment.

Figure 16:
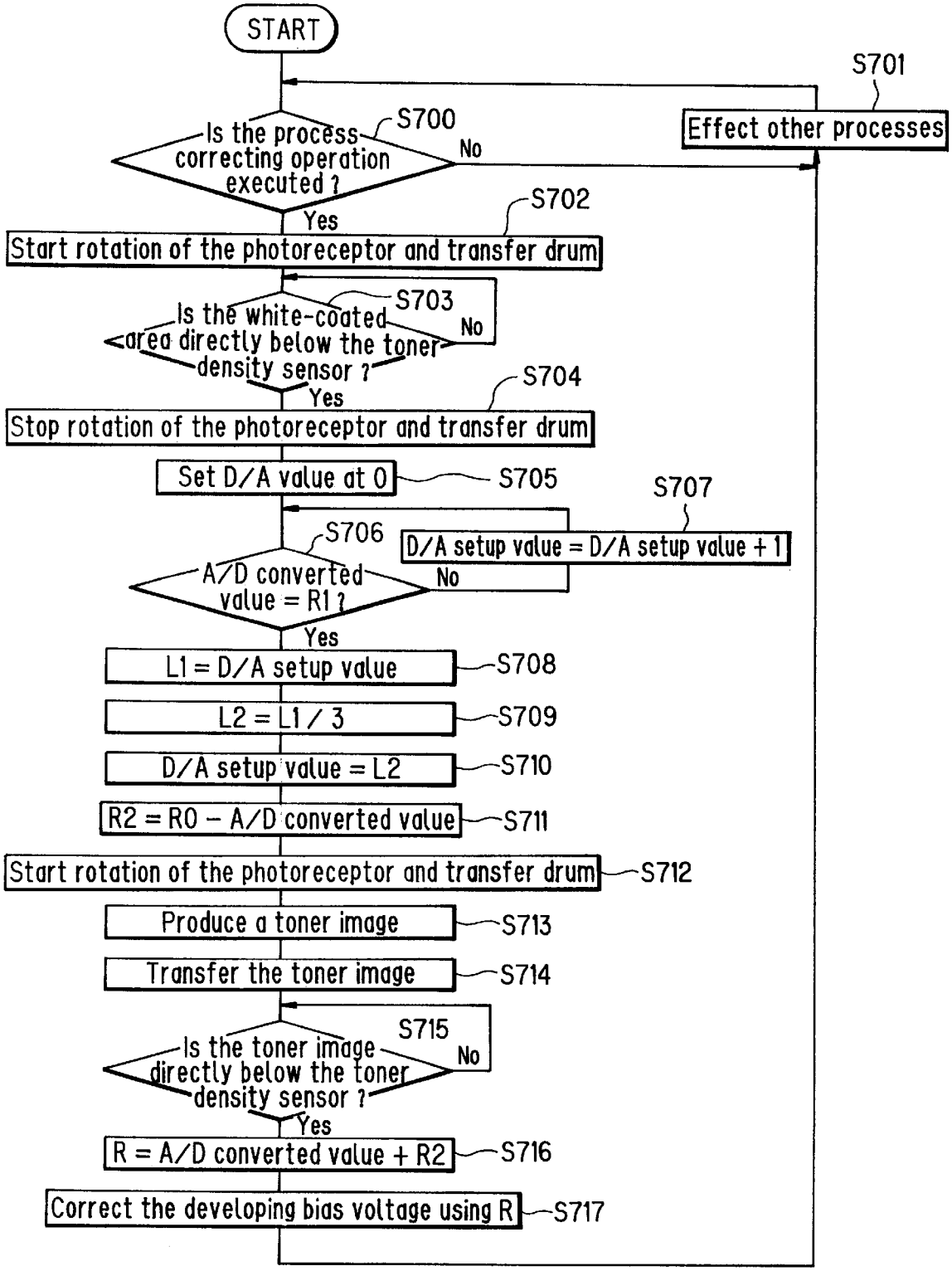
FIG. 16 is a flowchart showing a schematic procedure of operation in the seventh embodiment.

FIG. 16 is a flowchart showing a schematic procedure of the operation of this embodiment. Steps S700 to S703 are identical to Steps S601 to S604 in FIG. 15. When white-coated area 21 has arrived at the predetermined position under the toner density sensor, the motion of driving motor 29 for photoreceptor 1 and transfer drum 5 is suspended temporarily (S704). A similar correcting operation to that shown in FIG. 7 is performed so that whilst motor 29 is stopped, the first intensity of emitted light L1 and the sensor correction value R2 are determined (S705 to S711). When the determination of the correction value is complete, the driving motor is restarted (S712) so that the operation of measuring the toner density for correcting the image forming system starts (S713 to S717). In this method, the correction to the sensor is performed by measuring the toner density at one point in white-coated area 21. The determination of the first intensity of emitted light is made and the measurement of the sensor correction value with the second intensity of emitted light are implemented whilst the motion of driving motor 29 is temporarily suspended. As a result, even if there is some uneven distribution in the reflectance of white-coated area 21, the influence is reduced since the correcting operation is carried out at the same point.

Figure 17:
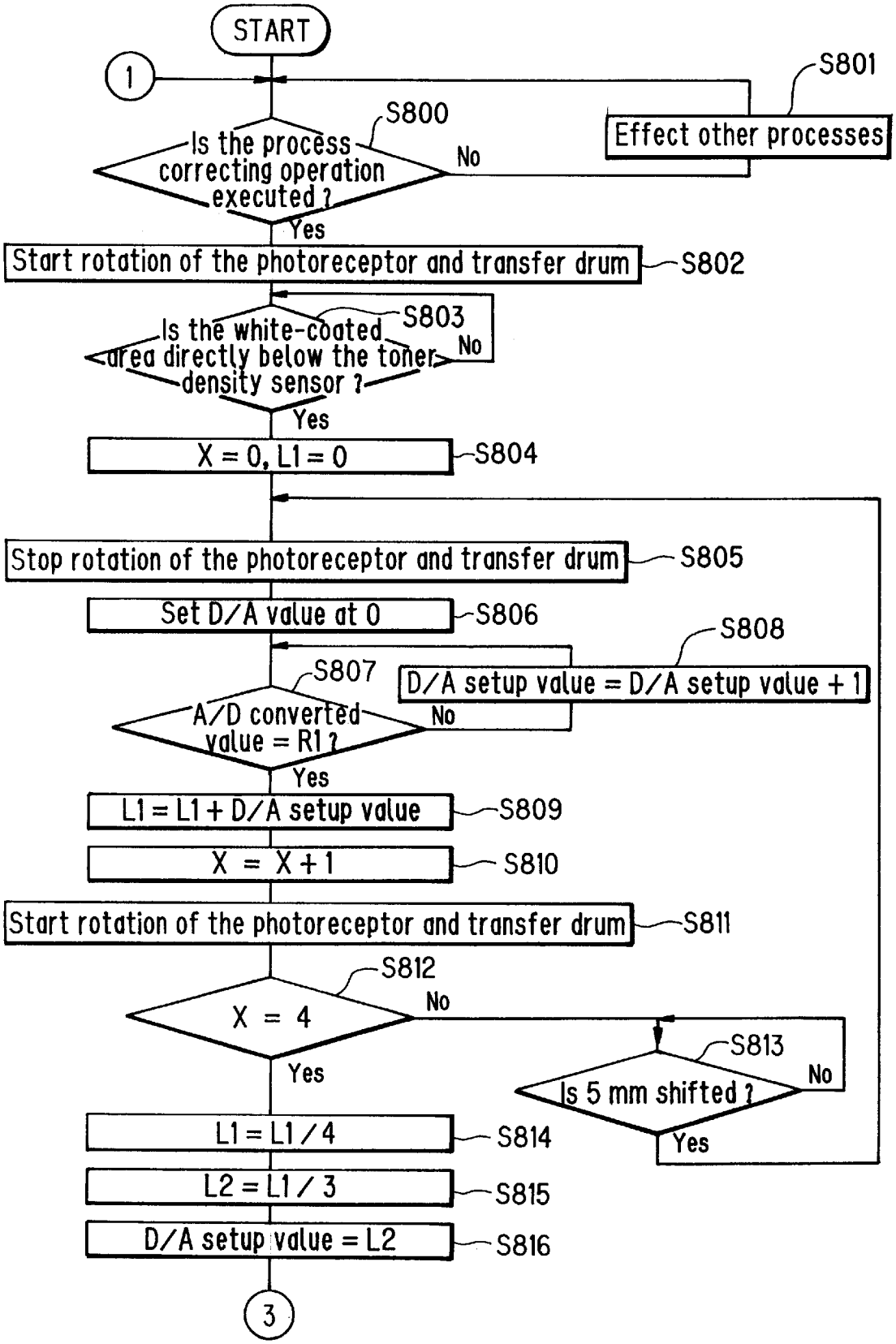
FIG. 17 is a flowchart showing a variational schematic procedure of operation in the seventh embodiment.
Figure 18:
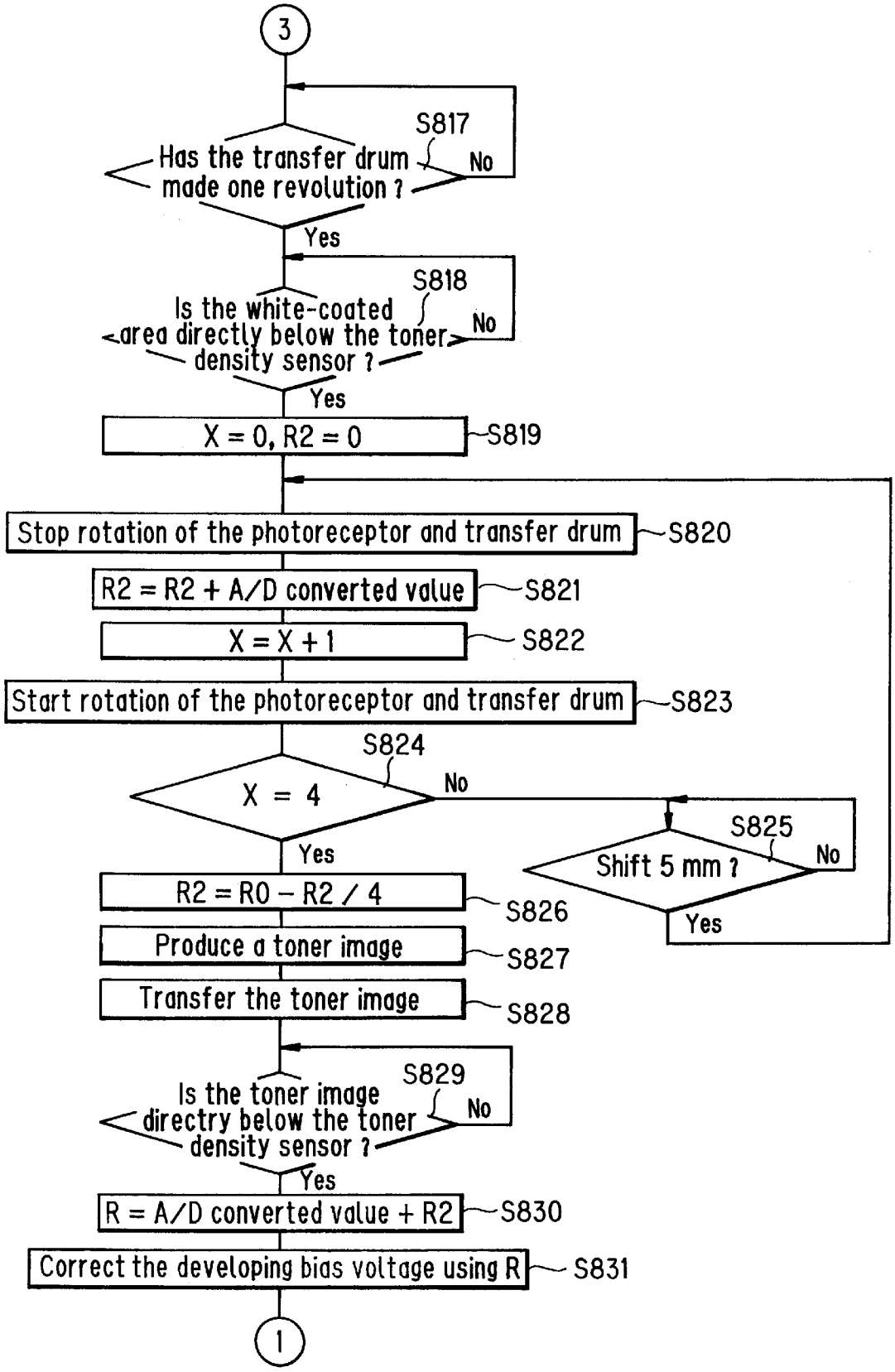
FIG. 18 is a flowchart following FIG. 17.

FIGS. 17 and 18 are a flowchart showing a schematic procedure of operation in accordance with a variation of this embodiment. In this variational embodiment, driving motor 29 is suspended four times (S805) so that measurement for determining the first intensity of emitted light is implemented at four sites, which are 5 mm apart from one to the next. The thus obtained measurements are averaged and based on this the second intensity of emitted light is determined. At S804, the count of measurements X and L1 for determining the average first intensity of emitted light are initialized or set at 0. From S806 to S808, one round of measurement for determining the light intensity is performed and the D/A setup value is added to L1 (S809). When one round of measurement is complete (S810), the motor is restarted to rotate (S811) to shift 5 mm to the next point for measurement (S812→S813→S805). In this way, the mean value of the measurement value is determined as L1 at S814, and the second intensity of emitted light L2 is set at one-third of L1 (S815). When transfer drum 5 has made one revolution (S817) and the area where the first intensity of emitted light was measured has arrived at the position for measurement (S818), R2 for storage of the A/D converted result and the count of measurements X are initialized (S819). From S820 to S825, the sum of the intensities of received light with L2 is determined in a similar manner to that when determining L1, and their mean value is calculated at S826. The density of the toner image formed with the averaged L1 is measured (S827 to S829), and the measurement value is corrected using R2 (S830).

Since actuator 19 with a sensor is provided on the side of transfer drum 5 as shown in FIG. 2 in order to detect the rotational position of the transfer drum, CPU 6 can detect transfer drum 5 at the home position, once in one revolution.

CPU 6 has a timer as shown in FIG. 3 and hence can distinguish how far transfer drum 5 has rotated from the home position. Therefore, it is possible to exactly detect a particular point in white-coated area 21 reaching the position of the toner density sensor. This assures that reading of the photosensor output with the second intensity of emitted light in the second round of revolution can be implemented at the same position as the first intensity of emitted light was determined. This feature, in addition to the removal, by averaging, of the influence of uneven distribution of the reflectance across white-coated area 21, lends itself to performing measurement of the sensor correction value with a higher precision.

In accordance with the first aspect of the invention, on the occasion of correcting the characteristics of the sensor for measuring the toner density, it is possible to correct the sensor characteristics at two operational points of the sensor by irradiating the reflective element having a specified reflectance as a reference with two levels of emitted light intensities, thus it becomes possible to calculate the correction values with a higher precision in order to correct the operational conditions of the image forming system. Further, since the correction needs only one reflective element having a single level of reflectance, the cost required for reflective elements can be reduced.

In accordance with the second aspect of the invention, in the case where different colors of toner having different values of reflectance are used and even if the toner density sensor has non-linear sensing characteristics, it is possible to obtain correction values at appropriately selected operating points suited to typical density values of plural toner images to be measured, and hence it is possible to achieve precise correction for the toners having different values of reflectance.

In accordance with the third and fourth aspects of the invention, since the first and second intensities of emitted light are set so as to fall within the sensitive range of the photosensor and the first intensity of emitted light is set greater than the second intensity of emitted light, it is possible to determine the sensor correction value in the region close to the operating point of the sensor on the occasion of actual measurement of the density of a toner image, and hence achieve precise correction.

In accordance with the fifth and sixth aspects of the invention, a reflective element is used as the background for the measurement of the density of black toner, it is not necessary to provide an extra element as the background for measuring the density of the black toner image, so that is possible to suppress the cost compared to the case where particular parts are provided separately. Since color toners have high values of reflectance, the background for them is adapted to have a higher reflectance than those. As a result, it is possible to select characteristic points so as to permit pertinent correction for all the toners.

In accordance with the seventh and eighth aspects of the invention, even if the density of a toner image produced under the same image forming conditions varies due to various causes in the image forming system, it is possible to constantly obtain stable sensor correction values because the sensor correction values are determined within the range near the density to be measured.

In accordance with the ninth and tenth aspects of the invention, at least one of the image forming conditions is controlled so that the density of a toner image is adjusted so as to provide an intensity of received light from the toner image, which is close to the intensity of received light from the reflective element when the reflective element is illuminated with the second intensity of emitted light. As a result, it is possible to avoid a density of the toner image varying or deviating remarkably from the expected density of toner image in correcting the sensor characteristics, thus it is possible to constantly produce a stable sensor correction value.

In accordance with the eleventh and twelfth aspects of the invention, since the first and second intensities of light are measured at the same position in the reflective element, it is possible to achieve stable correction to the measurement even if the reflective element has unevenness in its reflectance.

In accordance with the thirteenth and fourteenth aspects of the invention, since a plurality of measurements are averaged to determine a correction value, the correction will not be affected by the influence of unevenness in reflectance.

What is claimed is:

1. An image forming apparatus with a toner density measuring function, for forming a toner image by exposing a charged photoreceptor to light so as to form a static latent image thereon and developing the latent image with toner, said image forming apparatus with a toner density measuring function comprising:

a light emitting portion of which the intensity of light can be adjusted;

a toner image forming portion for forming a toner image for the measurement of toner density;

a reflective element having a constant reflectance for reflecting the light emitted from the light emitting portion;

a photo sensing portion for receiving the reflected light from the reflective element or the toner image;

a first light intensity determining means for determining the first intensity of light to be emitted from the light emitting portion in a way that causes the photo sensing portion to produce a predetermined output value when receiving the reflected light from the reflective element;

a second light intensity determining means for setting the second intensity of light emitted from the light emitting portion, at a level different from that of the first intensity of emitted light;

a means of correcting density measurements which compares to a standard value the outputs from the photo sensing portion when receiving the reflected light from the reflective element in the cases where the first and second intensities of emitted light are used and causes the output from the photo sensing portion for the toner density measured when the first intensity of emitted light is radiated to approach the standard value; and wherein the first light intensity determining means sets the first intensity of emitted light at a level which falls within the sensitive range of the photo sensing portion and is higher than the second intensity of emitted light.

2. The image forming apparatus with a toner density measuring function according to claim 1, wherein the reflective element is used as the background for the measurement of the density of the black toner and has a higher reflectance than that of any other toner image.

3. The image forming apparatus with a toner density measuring function according to claim 1, wherein the reflective element is provided so as to move relative to the light emitting portion and the photo sensing portion, and the operations of the first and second light intensity determining means are executed at the same position in the reflective element.

4. The image forming apparatus with a toner density measuring function according to claim 1, wherein the reflective element is moved relative to the light emitting portion and the photo sensing portion so as to effect measurement at plural sites and the measurements are averaged to be used for correction.

5. An image forming apparatus with a toner density measuring function, for forming a toner image by exposing a charged photoreceptor to light so as to form a static latent image thereon and developing the latent image with toner, said image forming apparatus with a toner measuring function compnsing:

a light emitting portion of emitting portion of which the intensity of light can be adjusted;

a toner image forming portion for forming a toner image for the measurement of toner density;

a reflective element having a constant reflectance for reflecting the light emitted from the light emitting portion;

a photo sensing portion for receiving the reflected light from the reflective element or the toner image;

a first light intensity determining means for determining the first intensity of light to be emitted from the light emitting portion in a way that causes the photo sensing portion to produce a predetermined output value when receiving the reflected light from the reflective element;

a second light intensity determining means for setting the second intensity of light emitted from the light emitting portion, at a level different from that of the first intensity of emitted light;

a means of correcting density measurements which compares to a standard value the outputs from the photo sensing portion when receiving the reflected light from the reflective element in the cases where the first and second intensities of emitted light are used and causes the output from the photo sensing portion for the toner density measured when the first intensity of emitted light is radiated to approach the standard value;

wherein the second light intensity determining means determines the intensity of emitted light for each of plural colors of toner, and the means of correcting density measurements corrects the measurement value for each of the plural colors of toner; and wherein the first light intensity determining means sets the first intensity of emitted light at a level which falls within the sensitive range of the photo sensing portion and is higher than the second intensity of emitted light.

6. The image forming apparatus with a toner density measuring function according to claim 5, wherein the reflective element is used as the background for the measurement of the density of the black toner and has a higher reflectance than that of any other toner image.

7. The image forming apparatus with a toner density measuring function according claim 5, wherein the reflective element is provided so as to move relative to the light emitting portion and the photo sensing portion, and the operations of the first and second light intensity determining means are executed at the same position in the reflective element.

8. The image forming apparatus with a toner density measuring function according to claim 5, wherein the reflective element is moved relative to the light emitting portion and the photo sensing portion so as to effect measurement at plural sites and the measurements are averaged to be used for correction.

9. An image forming apparatus with a toner density measuring function, for forming a toner image by exposing a charged photoreceptor to light so as to form a static latent image thereon and developing the latent image with toner, said image forming apparatus with a toner density measuring function comprising:

a light emitting portion of which the intensity of light can be adjusted;

a toner image forming portion for forming a toner image for the measurement of toner density;

a reflective element having a constant reflectance for reflecting the light emitted from the light emitting portion;

a photo sensing portion for receiving the reflected light from the reflective element or the toner image;

a first light intensity determining means for determining the first intensity of light to be emitted from the light emitting portion in a way that causes the photo sensing portion to produce a predetermined output value when receiving the reflected light from the reflective element;

a second light intensity determining means for setting the second intensity of light emitted from the light emitting portion, at a level different from that of the first intensity of emitted light;

a means of correcting density measurements which compares to a standard value the outputs from the photo sensing portion when receiving the reflected light from the reflective element in the cases where the first and second intensities of emitted light are used and causes the output from the photo sensing portion for the toner density measured when the first intensity of emitted light is radiated to approach the standard value; and wherein the second light intensity determining means sets the second intensity of emitted light at such a level that the output value from the photo sensing portion when the toner image is measured with the first intensity of emitted light becomes approximately equal to the output value from the photo sensing portion when the reflective element is measured with the second intensity of emitted light.

10. The image forming apparatus with a toner density measuring function according to claim 9, wherein the reflective element is used as the background for the measurement of the density of the black toner and has a higher reflectance than that of any other toner image.

11. The image forming apparatus with a toner density measuring function according to claim 9, wherein the reflective element is provided so as to move relative to the light emitting portion and the photo sensing portion, and the operations of the first and second light intensity determining means are executed at the same position in the reflective element.

12. The image forming apparatus with a toner density measuring function according to claim 9, wherein the reflective element is moved relative to the light emitting portion and the photo sensing portion so as to effect measurement at plural sites and the measurements are averaged to be used for correction.

13. An image forming apparatus with a toner density measuring function, for forming a toner image by exposing a charged photoreceptor to light so as to form a static latent image thereon and developing the latent image with toner, said image forming apparatus with a toner measuring function comprising:

a light emitting portion of emitting portion of which the intensity of light can be adjusted;

a toner image forming portion for forming a toner image for the measurement of toner density;

a reflective element having a constant reflectance for reflecting the light emitted from the light emitting portion;

a photo sensing portion for receiving the reflected light from the reflective element or the toner image;

a first light intensity determining means for determining the first intensity of light to be emitted from the light emitting portion in a way that causes the photo sensing portion to produce a predetermined output value when receiving the reflected light from the reflective element;

a second light intensity determining means for setting the second intensity of light emitted from the light emitting portion, at a level different from that of the first intensity of emitted light;

a means of correcting density measurements which compares to a standard value the outputs from the photo sensing portion when receiving the reflected light from the reflective element in the cases where the first and second intensities of emitted light are used and causes the output from the photo sensing portion for the toner density measured when the first intensity of emitted light is radiated to approach the standard value;

wherein the second light intensity determining means determines the intensity of emitted light for each of plural colors of toner, and the means of correcting density measurements corrects the measurement value for each of the plural colors of toner; and wherein the second light intensity determining means sets the second intensity of emitted light at such a level that the output value from the photo sensing portion when the toner image is measured with the first intensity of emitted light becomes approximately equal to the output value from the photo sensing portion when the reflective element is measured with the second intensity of emitted light.

14. The image forming apparatus with a toner density measuring function according to claim 13, wherein the reflective element is used as the background for the measurement of the density of the black toner and has a higher reflectance than that of any other toner image.

15. The image forming apparatus with a toner density measuring function according to claim 13, wherein the reflective element is provided so as to move relative to the light emitting portion and the photo sensing portion, and the operations of the first and second light intensity determining means are executed at the same position in the reflective element.

16. The image forming apparatus with a toner density measuring function according to claim 13, wherein the reflective element is moved relative to the light emitting portion and the photo sensing portion so as to effect measurement at plural sites and the measurements are averaged to be used for correction.

17. An image forming apparatus with a toner density measuring function, for forming a toner image by exposing a charged photoreceptor to light so as to form a static latent image thereon and developing the latent image with toner, said image forming apparatus with a toner density measuring function comprising:

a light emitting portion of which the intensity of light can be adjusted;

a toner image forming portion for forming a toner image for the measurement of toner density;

a reflective element having a constant reflectance for reflecting the light emitted from the light emitting portion;

a photo sensing portion for receiving the reflected light from the reflective element or the toner image;

a first light intensity determining means for determining the first intensity of light to be emitted from the light emitting portion in a way that causes the photo sensing portion to produce a predetermined output value when receiving the reflected light from the reflective element;

a second light intensity determining means for setting the second intensity of light emitted from the light emitting portion, at a level different from that of the first intensity of emitted light;

a means of correcting density measurements which compares to a standard value the outputs from the photo sensing portion when receiving the reflected light from the reflective element in the cases where the first and second intensities of emitted light are used and causes the output from the photo sensing portion for the toner density measured when the first intensity of emitted light is radiated to approach the standard value; and wherein, based on the intensity of received light as of the toner image obtained when the density of the toner image formed on the toner image forming portion was measured, at least one of the image forming conditions is controlled so that the density of the toner image is adjusted so as to provide an intensity of received light from the toner image, which is close to the intensity of received light from the reflective element when the reflective element is illuminated with the second intensity of emitted light.

18. The image forming apparatus with a toner density measuring function according to claim 17, wherein the reflective element is used as the background for the measurement of the density of the black toner and has a higher reflectance than that of any other toner image.

19. The image forming apparatus with a toner density measuring function according to claim 17, wherein the reflective element is provided so as to move relative to the light emitting portion and the photo sensing portion, and the operations of the first and second light intensity determining means are executed at the same position in the reflective element.

20. The image forming apparatus with a toner density measuring function according to claim 17, wherein the reflective element is moved relative to the light emitting portion and the photo sensing portion so as to effect measurement at plural sites and the measurements are averaged to be used for correction.

21. An image forming apparatus with a toner density measuring function, for forming a toner image by exposing a charged photoreceptor to light so as to form a static latent image thereon and developing the latent image with toner, said image forming apparatus with a toner measuring function comprising:

a light emitting portion of emitting portion of which the intensity of light can be adjusted;

a toner image forming portion for forming a toner image for the measurement of toner density;

a reflective element having a constant reflectance for reflecting the light emitted from the light emitting portion;

a photo sensing portion for receiving the reflected light from the reflective element or the toner image;

a first light intensity determining means for determining the first intensity of light to be emitted from the light emitting portion in a way that causes the photo sensing portion to produce a predetermined output value when receiving the reflected light from the reflective element;

a second light intensity determining means for setting the second intensity of light emitted from the light emitting portion, at a level different from that of the first intensity of emitted light;

a means of correcting density measurements which compares to a standard value the outputs from the photo sensing portion when receiving the reflected light from the reflective element in the cases where the first and second intensities of emitted light are used and causes the output from the photo sensing portion for the toner density measured when the first intensity of emitted light is radiated to approach the standard value;

wherein the second light intensity determining means determines the intensity of emitted light for each of plural colors of toner, and the means of correcting density measurements corrects the measurement value for each of the plural colors of toner; and wherein, based on the intensity of received light as of the toner image obtained when the density of the toner image formed on the toner image forming portion was measured, at least one of the image forming conditions is controlled so that the density of the toner image is adjusted so as to provide an intensity of received light from the toner image, which is close to the intensity of received light from the reflective element when the reflective element is illuminated with the second intensity of emitted light.

22. The image forming apparatus with a toner density measuring function according to claim 21, wherein the reflective element is used as the background for the measurement of the density of the black toner and has a higher reflectance than that of any other toner image.

23. The image forming apparatus with a toner density measuring function according to claim 21, wherein the reflective element is provided so as to move relative to the light emitting portion and the photo sensing portion, and the operations of the first and second light intensity determining means are executed at the same position in the reflective element.

24. The image forming apparatus with a toner density measuring function according to claim 21, wherein the reflective element is moved relative to the light emitting portion and the photo sensing portion so as to effect measurement at plural sites and the measurements are averaged to be used for correction.

* * * * *